US009381566B2

(12) United States Patent
Bewlay et al.

(10) Patent No.: US 9,381,566 B2
(45) Date of Patent: Jul. 5, 2016

(54) CERAMIC CORE COMPOSITIONS, METHODS FOR MAKING CORES, METHODS FOR CASTING HOLLOW TITANIUM-CONTAINING ARTICLES, AND HOLLOW TITANIUM-CONTAINING ARTICLES

(71) Applicant: GENERAL ELECTRIC COMPANY, Schenectady, NY (US)

(72) Inventors: Bernard Patrick Bewlay, Niskayuna, NY (US); Joan McKiever, Ballston Lake, NY (US); Brian Michael Ellis, Mayfield, NY (US); Nicholas Vincent McLasky, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 14/743,151

(22) Filed: Jun. 18, 2015

(65) Prior Publication Data

US 2016/0008872 A1 Jan. 14, 2016

Related U.S. Application Data

(62) Division of application No. 14/030,005, filed on Sep. 18, 2013, now Pat. No. 9,061,350.

(51) Int. Cl.

| | |
|---|---|
| ***B22C 9/04*** | (2006.01) |
| ***B22C 9/24*** | (2006.01) |
| ***B22D 21/02*** | (2006.01) |
| ***B22C 1/18*** | (2006.01) |
| ***B22C 9/10*** | (2006.01) |

(52) U.S. Cl.

CPC ..... *B22C 9/046* (2013.01); *B22C 1/181* (2013.01); *B22C 9/10* (2013.01); *B22C 9/24* (2013.01); *B22D 21/022* (2013.01)

(58) Field of Classification Search

CPC ..... B22C 9/02; B22C 9/04; B22C 1/06; B22C 1/181; B22C 21/005; B22C 21/02; B22C 21/022

USPC ..... 164/18, 23, 24, 516–529

See application file for complete search history.

(56) References Cited

U.S. PATENT DOCUMENTS

| | | | |
|---|---|---|---|
| 3,372,898 | A | 3/1968 | Townsend et al. |
| 4,830,083 | A | 5/1989 | Nakamura |

(Continued)

FOREIGN PATENT DOCUMENTS

| | | | |
|---|---|---|---|
| DE | 202008013345 | U1 | 12/2008 |
| WO | 9829353 | A1 | 7/1998 |
| WO | 2010040746 | A1 | 4/2010 |

OTHER PUBLICATIONS

Chapin et al., "A Metallurgical Evaluation of Refractory Compounds for Containing Molten Titanium: Part I—Carbon, Graphite and Carbides", Washington, DC, Naval Research Laboratory, pp. 1-21, Dec. 15, 1954.

(Continued)

*Primary Examiner* — Kevin E Yoon

(74) *Attorney, Agent, or Firm* — John P. Darling

(57) ABSTRACT

The disclosure relates generally to core compositions and methods of molding and the articles so molded. More specifically, the disclosure relates to core compositions and methods for casting hollow titanium-containing articles, and the hollow titanium-containing articles so molded.

15 Claims, 18 Drawing Sheets

(56) References Cited

U.S. PATENT DOCUMENTS

| | | | | |
|---|---|---|---|---|
| 5,018,271 | A | 5/1991 | Bailey et al. | |
| 5,394,933 | A | 3/1995 | Takayanagi | |
| 5,505,250 | A | 4/1996 | Jago | |
| 5,511,604 | A | 4/1996 | Ravenhall et al. | |
| 8,579,013 | B2 * | 11/2013 | Bewlay | C04B 28/06 106/38.9 |
| 8,858,697 | B2 * | 10/2014 | Bewlay | B22D 21/005 106/38.2 |
| 2006/0065383 | A1 | 3/2006 | Ortiz et al. | |
| 2011/0192324 | A1 * | 8/2011 | Knevels | C04B 28/26 106/691 |
| 2011/0203761 | A1 * | 8/2011 | Renkel | B22C 1/06 164/14 |

OTHER PUBLICATIONS

Chapin et al., "A Metallurgical Evaluation of Refractory Compounds for Containing Molten Titanium: Part II—Borides and Sulphides", Washington, DC, Naval Research Laboratory, pp. 1-30, Jan. 17, 1955.

Garfinkle, et al., "Reaction of Liquid Titanium with Some Refractory Compounds", ASM Transactions, vol. No. 58, pp. 521-531, 1965.

Saha et al., "On the Evaluation of Stability of Rare Earth Oxides as Face Coats for Investment Casting of Titanium" Metallurgical Transactions B, vol. No. 21B, pp. 559-566, Jun. 1990.

Schadlich-Stubenrauch et al., "Development of a New Centrifugal Investment Casting Process for the Production of Small, Thin Section and Filigree Castings of Titanium and Titanium Alloys", Giessereiforschung, vol. No. 43, Issue No. 4, pp. 141-161, 1991.

Sato et al., "A Technique for Casting Titanium Alloys with Lime Refractory", Communication presented to the 58th World Foundry Congress, Cracow, pp. 1-19, Sep. 1991.

Sato et al., "A New Process of Producing Titanium Alloy Castings", Transactions of the Japan Foundermen's Society, vol. No. 11, pp. 27-33, Oct. 1992.

Frueh et al., "Attempts to Develop a Ceramic Mould for Titanium Casting—A Review", International Journal of Cast Metals Research, vol. No. 9, Issue No. 4, pp. 233-239, 1996.

Reetz et al., "Keramische Werkstoffe fur Aluminum and Titanschmelzen", Giesserei, vol. No. 83, Issue No. 16, pp. 53-56, Aug. 1996.

PCT Search Report and Written Opinion issued in connection with corresponding Application No. PCT/US2014/051993 on Feb. 18, 2015.

* cited by examiner

A)
Cleaned

B)
Cut

- Transverse Slice cut longitudinally to expose internal surface
- After grit blasting, the TiAl has an excellent surface finish

- After grit blasting, the TiAl has an excellent surface finish
- Surface finish Ra of < 50 observed after grit blasting

- After grit blasting, the TiAl has an excellent surface finish

- After grit blasting, the TiAl has an excellent surface finish
- Surface finish Ra of < 50 observed after grit blasting Titanium Aluminide blade

CERAMIC CORE COMPOSITIONS, METHODS FOR MAKING CORES, METHODS FOR CASTING HOLLOW TITANIUM-CONTAINING ARTICLES, AND HOLLOW TITANIUM-CONTAINING ARTICLES

CROSS REFERENCE TO RELATED APPLICATION

This application is a divisional of U.S. application Ser. No. 14/030,005, now U.S. Pat. No. 9,061,350.

BACKGROUND

Modern gas or combustion turbines must satisfy the highest demands with respect to reliability, weight, power, economy, and operating service life. In the development of such turbines, the material selection, the search for new suitable materials, as well as the search for new production methods, among other things, play a role in meeting standards and satisfying the demand.

The materials used for gas turbines may include titanium alloys, nickel alloys (also called super alloys) and high strength steels. For aircraft engines, titanium alloys are generally used for compressor parts, nickel alloys are suitable for the hot parts of the aircraft engine, and the high strength steels are used, for example, for compressor housings and turbine housings. The highly loaded or stressed gas turbine components, such as components for a compressor for example, are typically forged parts. Components for a turbine, on the other hand, are typically embodied as investment cast parts.

Although investment casting is not a new process, the investment casting market continues to grow as the demand for more intricate and complicated parts increase. Because of the great demand for high quality, precision castings, there continuously remains a need to develop new ways to make investment castings more quickly, efficiently, cheaply and of higher quality.

Conventional investment mold compounds that consist of fused silica, cristobalite, gypsum, or the like, that are used in casting jewelry and dental prostheses industries are generally not suitable for casting reactive alloys, such as titanium alloys. One reason is because there is a reaction between molten titanium and the investment mold.

There is a need for a simple investment mold that does not react significantly with titanium and titanium aluminide alloys. Approaches have been adopted previously with ceramic shell molds for titanium alloy castings. In the prior examples, in order to reduce the limitations of the conventional investment mold compounds, several additional mold materials have been developed. For example, an investment compound was developed of an oxidation-expansion type in which magnesium oxide or zirconia was used as a main component and metallic zirconium was added to the main constituent to compensate for the shrinkage due to solidification of the cast metal. There is thus also a need for simple and reliable investment casting methods which allow easy extraction of near-net-shape metal or metal alloys from an investment mold that does not react significantly with the metal or metal alloy.

Prior Art non-metallic composite turbine blades are, in general, of the un-cooled solid type. See for example U.S. Pat. No. 5,018,271 to Bailey et al (1991). The high thermal conductivities of this class of material requires complicated solutions to heat transferred from the flow path around the blade into the supporting blade rotor and disc structure. These design solutions are complex and add additional weight to the blade and supporting disc structure. In addition to the aforementioned, compared to current metallic blade designs, coolable, lighter-in-weight blades are desirable to overcome the above prior art shortcomings.

SUMMARY

One object of the present disclosure is to provide improvements to a blade of a gas turbine engine.

Aspects of the present disclosure provide casting mold compositions, methods of casting, and cast articles that overcome the limitations of the conventional techniques. Though some aspect of the disclosure may be directed toward the fabrication of components for the aerospace industry, for example, engine turbine blades, aspects of the present disclosure may be employed in the fabrication of any component in any industry, in particular, those components containing titanium and/or titanium alloys.

One aspect of the present disclosure is directed to a ceramic core composition comprising calcium aluminate particles and one or more large scale particles. In one embodiment, the composition comprises fine scale calcium aluminate and wherein said large particles are hollow. In another embodiment, the calcium aluminate particles comprise particles of calcium monoaluminate, calcium dialuminate, and mayenite. The composition further comprises, in one example, of calcium aluminate with a particle size of less than about 50 microns.

In one embodiment, the large scale particles comprise hollow oxide particles. In another embodiment, the large scale particles are hollow and they comprise aluminum oxide particles, magnesium oxide particles, calcium oxide particles, zirconium oxide particles, titanium oxide particles, or combinations thereof. In another embodiment, the large scale particles comprise a ceramic, such as calcium aluminate, calcium hexaluminate, zirconia, or combinations thereof. In one embodiment, the hollow oxide particles comprise hollow alumina spheres or bubbles.

The particular size of the particles is a feature of the present disclosure. In particular, the large scale particles of the composition comprise particles that are more than about 70 microns in outside dimension. In one embodiment, the large scale particles comprise particles of about 70 microns to about 1000 microns in outside dimension. In one embodiment, at least 50% of the calcium aluminate particles are less than about 10 microns in outside dimension. In another embodiment, the calcium aluminate particles comprise particles of up to about 50 microns in outside dimension, and the large scale particles comprise particles of from about 70 to about 1000 microns in outside dimension.

One aspect of the present disclosure is directed to a casting core formed from a ceramic core composition comprising calcium aluminate particles and one or more large scale particles. Another aspect of the present disclosure is directed to a hollow titanium aluminide-containing article formed using a casting core formed from a ceramic core composition comprising calcium aluminate particles and one or more large scale particles. In one embodiment, the hollow titanium aluminide-containing article comprises a hollow titanium aluminide turbine blade.

In one embodiment, the weight fraction of the calcium aluminate particles is greater than about 20% and less than about 80%. In another embodiment, the weight fraction of the large scale particles is from about 20% to about 65%.

In one embodiment, the density of the core is from about 0.8 g/cc to about 3 g/cc. In another embodiment, the core composition does not shrink more than about one percent upon firing at about 700 to 1400 degrees Celsius for about one hour. In one embodiment, after the ceramic core composition is sintered, the ceramic core is substantially free of silica. In one embodiment, before sintering of the core composition the ceramic core comprises hollow alumina particles, and after sintering, the core comprises no more than about 0.5% by weight (based on the total weight of the core) of silica.

One aspect of the present disclosure is directed to a sintered ceramic core for use in casting a titanium-containing article, said core comprising calcium aluminate particles and large scale particles. In one embodiment, the core comprises small scale calcium aluminate particles and large scale hollow particles. In one embodiment, the calcium aluminate particles comprise particles of calcium monoaluminate, calcium dialuminate, and mayenite. In one embodiment, after sintering, the core is substantially free of silica. In another embodiment, before sintering the ceramic core comprises hollow alumina particles, and after sintering the core comprises no more than about 0.5% by weight (based on the total weight of the core) of free silica.

In one embodiment, the weight fraction of the calcium aluminate particles of the ceramic core is greater than about 20% and less than about 80%. In another embodiment, the weight fraction of the large scale particles in the ceramic core is from about 20% to about 65%. In one embodiment, at least 50% of the calcium aluminate particles in the ceramic core are less than about 10 microns in outside dimension. In another embodiment, the calcium aluminate particles in the ceramic core comprise particles of up to about 50 microns in outside dimension, and the large scale particles in the ceramic core comprise particles of from about 70 to about 1000 microns in outside dimension.

One aspect of the present disclosure is a sintered ceramic core, comprising calcium aluminate particles and large scale particles. In one embodiment, the ceramic core is encompassed within the mold and has a different composition to the mold. In one embodiment, the core is used to form a hollow titanium aluminide-containing article. In one embodiment, more than one core is present in the casting mold. In one embodiment, the casting mold has two, three or four different cavity locations in which each has a core within it. In one embodiment where more than one core is used, the cores may be connected to each other through a channel connecting two or more cavities housing the cores. In one embodiment where more than one core is used, the cores are separate, each within a defined location and not in contact with any other core. In another embodiment where more than one core is used, the composition of each of the cores may be different. In another embodiment where more than one core is used, all the cores have the same composition as each other.

One aspect of the present disclosure is a sintered ceramic core comprising calcium aluminate particles and hollow large scale particles, wherein the ceramic core is used to form a hollow titanium aluminide-containing article. Another aspect of the present disclosure is a hollow titanium aluminide-containing article comprising a calcium aluminate ceramic core, wherein the ceramic core comprises calcium aluminate particles and one or more large scale particles used to form the hollow titanium aluminide-containing article.

In one embodiment, the density of the core is from about 0.8 g/cc to about 3 g/cc. In another embodiment, the core composition does not shrink more than about one percent upon firing at about 700 to 1400 degrees Celsius for about one hour. One aspect of the present disclosure is a mold composition for casting a hollow titanium-containing article, comprising calcium aluminate particles comprising calcium monoaluminate, calcium dialuminate, and mayenite; and the ceramic core as taught herein. In one embodiment, the calcium aluminate particles comprise particles of calcium monoaluminate. In another embodiment, the calcium aluminate particles comprise particles of calcium monoaluminate, and calcium dialuminate.

In one aspect, the present disclosure is a casting mold comprising a ceramic core within a cavity of the mold, wherein the ceramic core comprises calcium aluminate particles and large scale particles. In one embodiment, the large scale particles are hollow and the core and the casting mold have different compositions. In another embodiment, one or more ceramic cores may be present within separate cavities of the casting mold, and the ceramic cores comprise calcium aluminate particles and hollow large scale particles. In another embodiment, the mold with the core is used to form a hollow titanium aluminide-containing article.

Another aspect of the present disclosure is a method for making a casting mold for casting a hollow titanium-containing article. The method comprises combining calcium aluminate particles, large scale particles and a liquid to produce a slurry of calcium aluminate particles and large scale particles in the liquid; introducing the slurry into a vessel that contains a fugitive pattern, the internal dimensions of the vessel define the external dimensions of the mold; and allowing the slurry to cure in the vessel to form a mold for casting a titanium-containing article. In one embodiment, fine scale calcium aluminate particles are used, along with large scale particles that are substantially hollow.

In another embodiment, the method further comprises introducing oxide particles to the slurry before introducing the slurry into a vessel for making a mold. The oxide particles that are used in the presently taught method comprise aluminum oxide particles, magnesium oxide particles, calcium oxide particles, zirconium oxide particles, titanium oxide particles, or combinations thereof. In one embodiment, the oxide particles used in the presently taught method comprise hollow oxide particles. In a particular example, the oxide particles comprise hollow alumina spheres.

The size of the particles used in the presently taught method is a feature of the presently taught method. As such, in one embodiment, at least 50% of the calcium aluminate particles used in the presently taught method are less than about 10 microns in outside dimension. In one embodiment of the presently taught method, the calcium aluminate particles comprise particles of up to about 50 microns in outside dimension, and the large scale particles comprise particles of from about 70 to about 1000 microns in outside dimension.

One aspect of the present disclosure is a method for making a casting mold for casting a hollow titanium-containing article as presently taught, wherein the casting mold comprises an investment casting mold for casting near-net-shape titanium aluminide articles.

One aspect of the present disclosure is a method for making a casting core for use in a casting mold for casting a hollow titanium-containing article as presently taught, wherein the casting mold comprises an investment casting mold for casting near-net-shape titanium aluminide articles.

One aspect of the present disclosure is a casting method for hollow titanium and titanium alloys. The method comprises obtaining an investment casting mold composition comprising calcium aluminate particles and large scale particles; pouring said investment casting mold composition into a vessel containing a fugitive pattern; curing said investment casting mold composition; removing said fugitive pattern from the mold; preheating the mold to a mold casting temperature; pouring molten titanium or titanium alloy into the heated mold; solidifying the molten titanium or titanium alloy and forming a solidified hollow titanium or titanium alloy casting; and removing the solidified hollow titanium or titanium alloy casting from the mold.

In one embodiment of the casting method, fine scale calcium aluminate particles are used, along with large scale particles that are substantially hollow. In another embodiment of the casting method, after removing said fugitive pattern from the mold and preheating the mold to a mold casting temperature, heating said mold to a temperature of about 450 degrees Celsius to about 1400 degrees Celsius, and then allowing said mold to cool to about room temperature. In one embodiment, the removing of the fugitive pattern comprises at least one of melting, dissolution, ignition, oven dewaxing, furnace dewaxing, steam autoclave dewaxing, or microwave dewaxing. After removing the solidified titanium or titanium alloy casting from the mold, in one example, the casting is inspected with X-ray radiography.

Another aspect of the present disclosure is a titanium or titanium alloy article made by the casting method as taught herein. The article, in one example, comprises a titanium aluminide-containing turbine blade.

One aspect of the present disclosure is a method of making a ceramic core, comprising combining calcium aluminate particles with large scale particles and a liquid to form a slurry; introducing the slurry into a die to produce a green product of an article-shaped body; and heating the green product under conditions sufficient to form a ceramic core. For making the ceramic core, in one embodiment, fine scale calcium aluminate particles are used along with large scale particles that are substantially hollow.

The method of making the ceramic core, in one example, comprises introducing oxide particles to the slurry before introducing the slurry into a die to produce an article-shaped body. These oxide particles comprise, in one example, hollow oxide particles. In one embodiment, the ceramic core is made using hollow oxide particles which comprise hollow alumina spheres.

In another embodiment, the core is made using calcium aluminate particles, wherein at least 50% of the calcium aluminate particles are less than about 10 microns in outside dimension. In a particular embodiment, the core is made using calcium aluminate particles which comprise particles of up to about 50 microns in outside dimension, and large scale particles which comprise particles of from about 70 to about 1000 microns in outside dimension.

One aspect of the present disclosure is a method for casting a hollow turbine component, comprising: (i) making a ceramic core by: a) combining calcium aluminate particles with large scale particles and a liquid to form a slurry; b) introducing the slurry into a die to produce a green product of an article-shaped body; and c) heating the green product under conditions sufficient to form a sintered ceramic core; (ii) disposing the ceramic core in a pre-selected position within a mold; (iii) introducing a molten titanium or titanium alloy-containing material into the mold; (iv) cooling the molten material, to form the turbine component within the mold; (v) separating the mold from the turbine component; and (vi) removing the core from the turbine component, so as to form a hollow turbine component. In one embodiment, the turbine component being cast is a turbine blade.

These and other aspects, features, and advantages of this disclosure will become apparent from the following detailed description of the various aspects of the disclosure taken in conjunction with the accompanying drawings.

BRIEF DESCRIPTION OF THE FIGURES

The subject matter, which is regarded as the invention, is particularly pointed out and distinctly claimed in the claims at the conclusion of the specification. The foregoing and other features and advantages of the disclosure will be readily understood from the following detailed description of aspects of the invention taken in conjunction with the accompanying drawings in which:

FIG. 1 shows both cleaned and cut slab castings produced, as indicated. The figure shows a typical slab casting that was cut to examine the transverse section to investigate the extent of any reaction between the core and the titanium alloy casting.

The partially removed core can be seen at higher magnification, and the internal surface of the casting can be observed in greater detail. It is also possible to see one of the platinum pins that we used to support the core in the mold. The platinum pins were not completely removed during casting. The casting is being observed in the as-cast condition; it has not been subjected to any heat treatment. The condition of the internal surface of the casting that has been generated by the calcium aluminate-containing core is excellent. Various sections of the core and casting show both the integrity of the core and the very low, if any, reaction between the core and the casting for this specific core formulation.

FIGS. 9-12 show photographs of the transverse slice from the cored section of the casting. The transverse slice was cut along the sides and the slice separated into two halves. This allowed the residual core to be removed and the internal surface of the hollow casting to be examined. The internal surface of the casting shows regions where the core was completely removed and grit blasted; the surface finish was excellent. The images of the internal surface of the casting also show regions where the core was not completely removed; this allows one to assess the level of interaction between the core and the casting. There is only a very thin scale of the calcium aluminate containing core on the casting, and this scale can be very easily removed by grit blasting, wire brushing, citrus washing, chemical cleaning, or other means well known in the art. These evaluations indicate that calcium aluminate containing core is a suitable technology for casting hollow titanium alloy and titanium aluminide alloy components.

Figure 13:
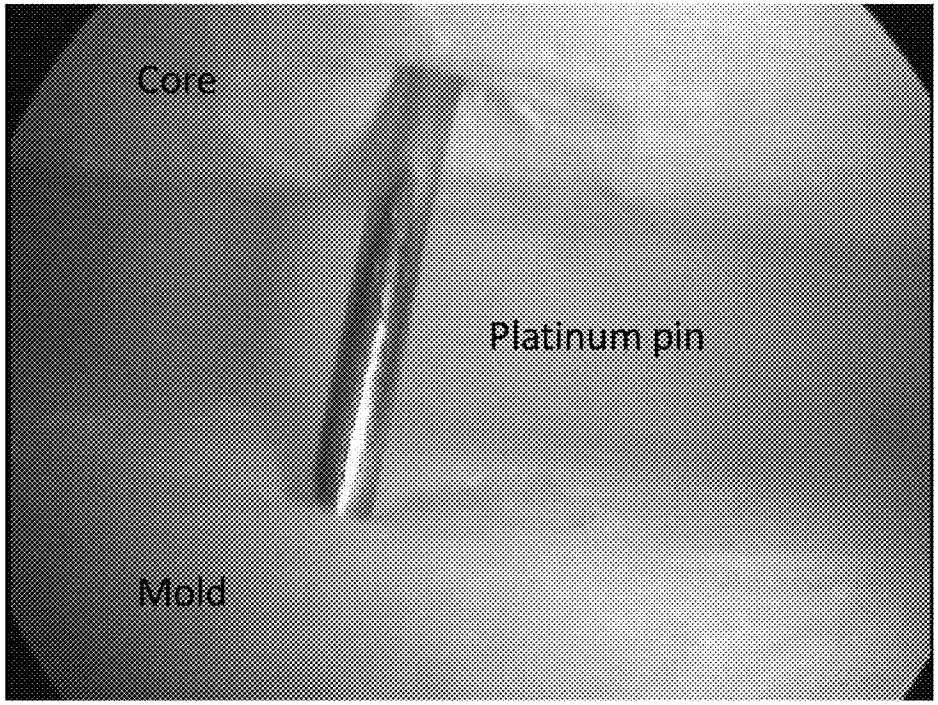

FIG. 13 shows bore scope pictures of a slab mold that contains a core with platinum pins holding the core suspended in the mold.

Figure 14:
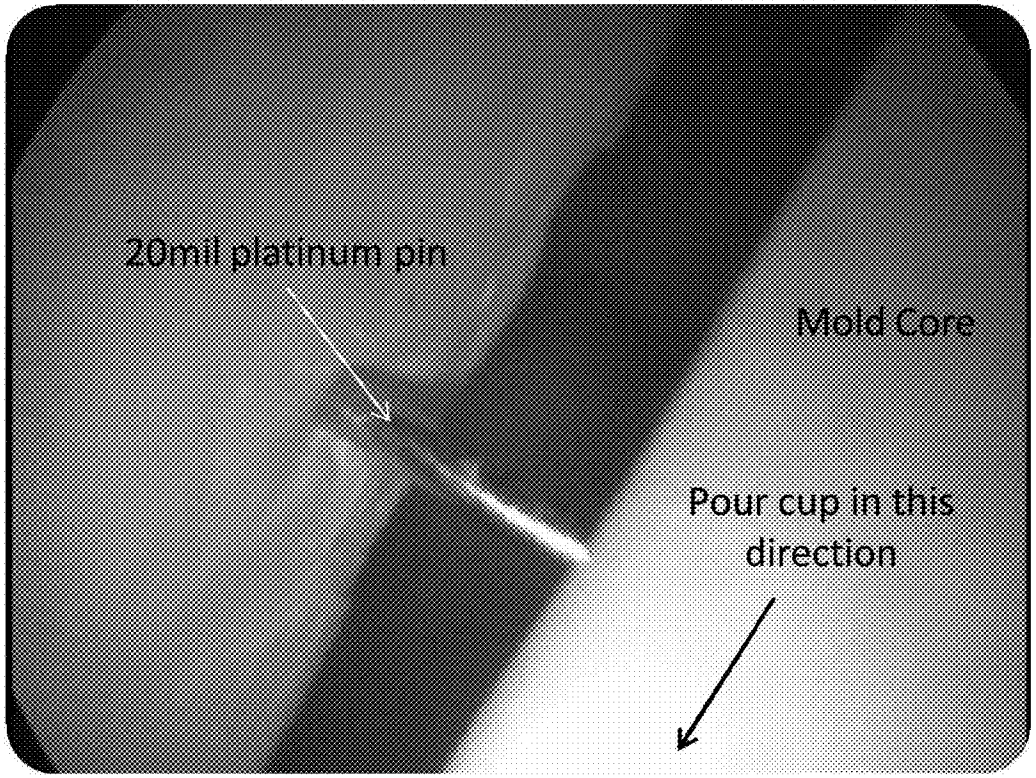

FIG. 14 shows a platinum pin supporting a calcium aluminate-containing core in a casting mold. The figure shows borescope pictures of a slab mold that contains a core with platinum pins holding the core suspended in the mold.

Figure 15:
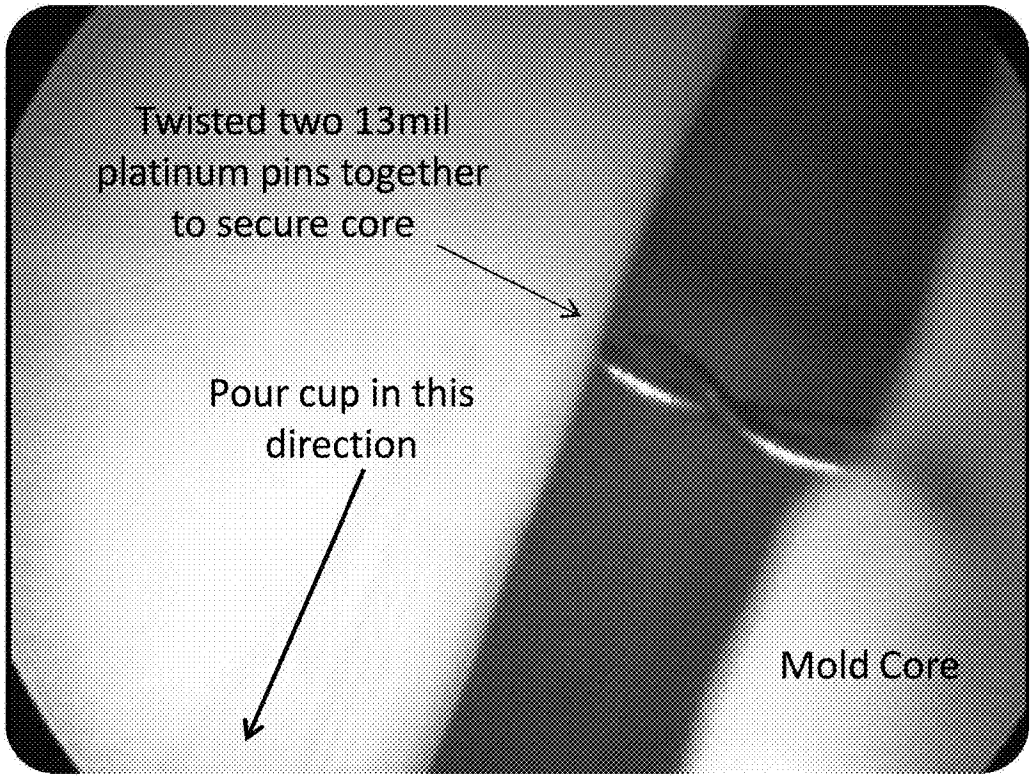

FIG. 15 shows a braided platinum pin supporting a calcium aluminate-containing core in a casting mold. The braided pin was formed, for example, by winding two smaller wires together. The figure shows bore scope pictures of a slab mold that contains a core with braided platinum pins holding the core suspended in the mold.

Figure 16:
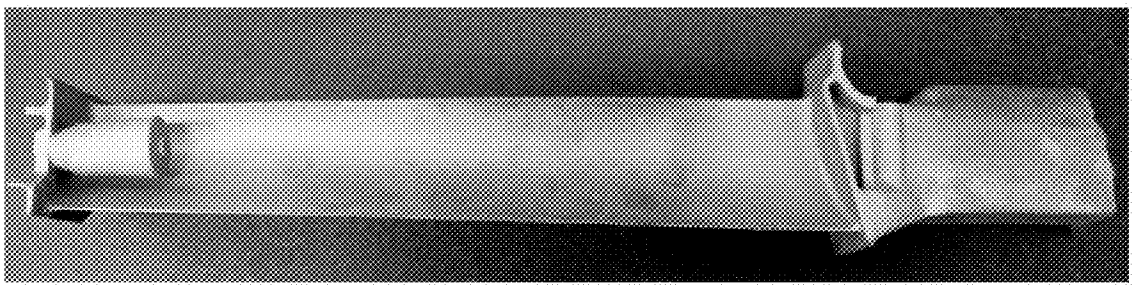

FIG. 16 shows a blade that has been produced with a calcium aluminate-containing core in it.

Figure 17A:
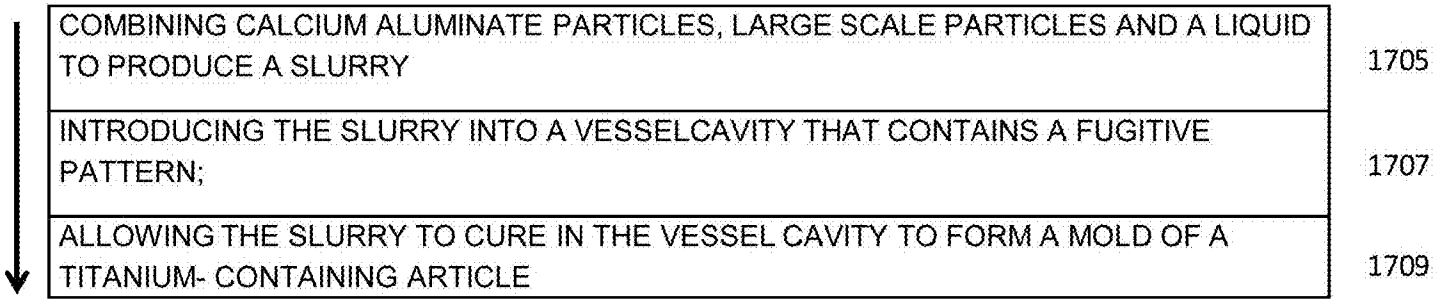
Figure 17B:
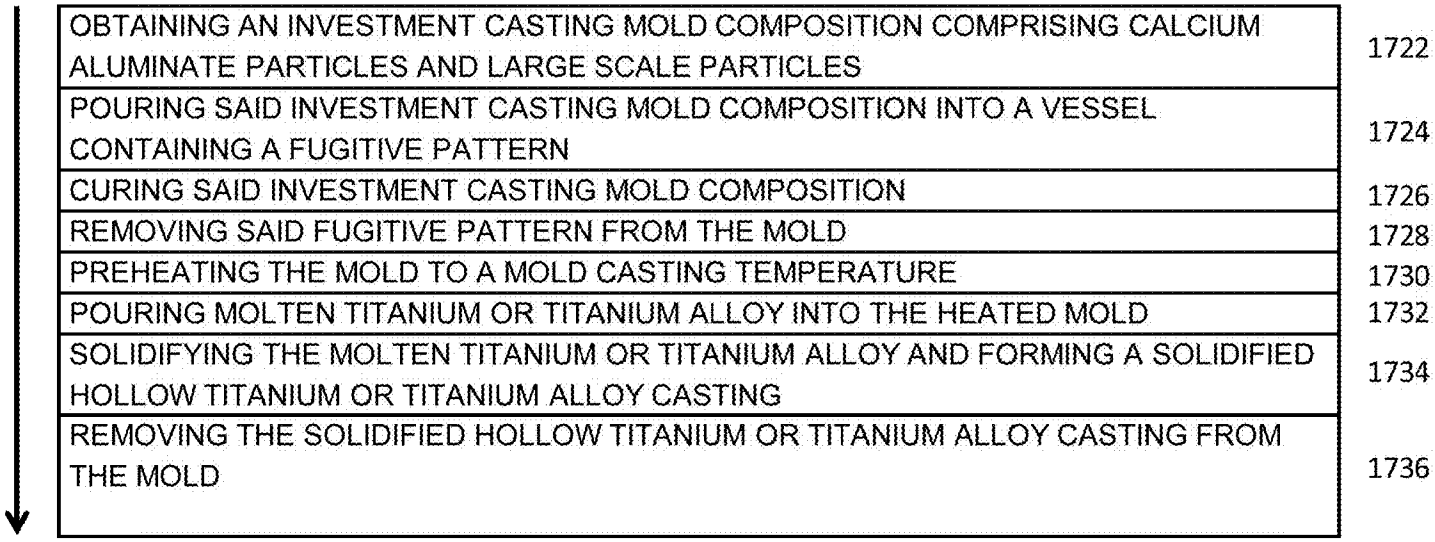

FIG. 17*a* shows a flow chart, in accordance with aspects of the disclosure, illustrating a method for making a casting mold for casting a hollow titanium-containing article. FIG. 17*b* shows a flow chart, in accordance with aspects of the disclosure, illustrating a casting method for hollow titanium and titanium alloys.

Figure 18A:
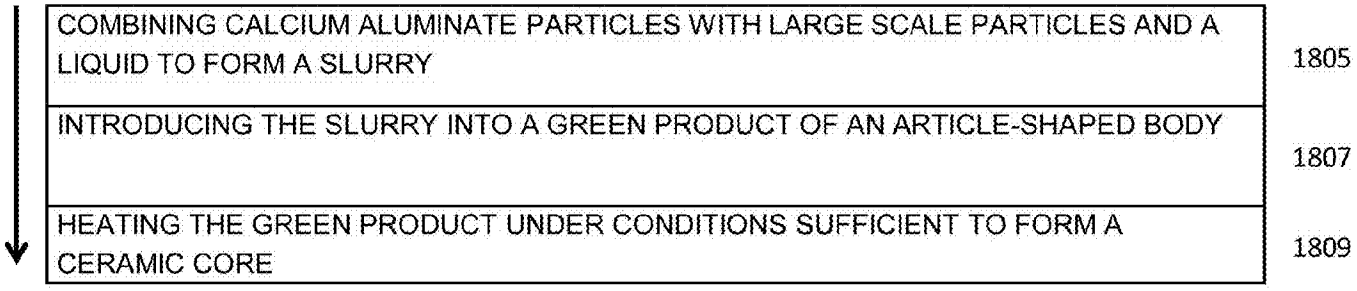
Figure 18B:
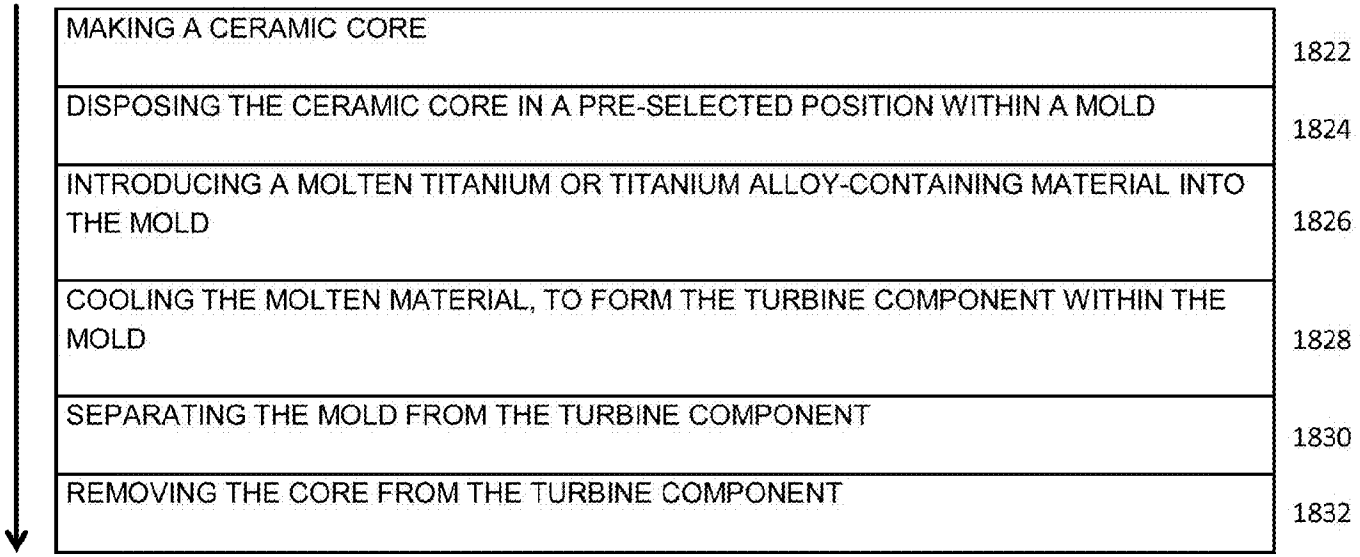

FIG. 18*a* shows a flow chart, in accordance with aspects of the disclosure, illustrating a method of making a ceramic core. FIG. 18*b* shows a flow chart, in accordance with aspects of the disclosure, illustrating a method for casting a hollow turbine component.

DETAILED DESCRIPTION

The use of the terms "a" and "an" and "the" and similar references in the context of describing the invention (especially in the context of the following claims) are to be construed to cover both the singular and the plural, unless otherwise indicated herein or clearly contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

The present disclosure relates generally to ceramic core compositions, casting cores and methods of making cores and related cast articles, and, more specifically, to core compositions, molds containing the core, and methods for casting hollow titanium-containing articles, and hollow titanium-containing articles so molded.

The manufacture of titanium based components by investment casting of titanium and its alloys in investment shell molds poses problems from the standpoint that the castings should be cast to "near-net-shape." That is, the components may be cast to substantially the final desired dimensions of the component, and require little or no final treatment or machining. For example, some conventional castings may require only a chemical milling operation to remove any surface contamination, such as alpha case, present on the casting. However, any sub-surface ceramic inclusions located below the alpha case in the casting are typically not removed by the chemical milling operation and may be formed due to the reaction between the mold and any reactive metal in the mold, for example, reactive titanium aluminide.

The present disclosure provides a new approach for casting near-net-shape hollow titanium and titanium aluminide components, such as, hollow turbine blades or airfoils. Embodiments of the present disclosure provide ceramic core compositions and casting methods that provide hollow titanium and titanium alloy components for example, for use in the aerospace, industrial and marine industry. In some aspects, the composition provides a mold that provides improved mold strength during mold making and/or increased resistance to reaction with the casting metal during casting. The molds and cores according to aspects of the disclosure may be capable of casting at high pressure, which is desirable for near-net-shape casting methods. Mold and core compositions, for example, containing calcium aluminate particles and alumina particles, and preferred constituent phases, have been identified that provide castings with improved properties.

In one aspect, the inventors discovered that calcium aluminate particles coupled with large scale particles can provide for a ceramic core composition used for making a casting mold for casting a hollow titanium-containing article, and related casting methods. The constituent phases of the core composition comprise calcium monoaluminate ($CaAl_2O_4$). The present inventors found calcium monoaluminate desirable for at least two reasons. First, it is understood by the inventors that calcium monoaluminate promotes hydraulic bond formation between the particles during the initial stages of mold making, and this hydraulic bonding is believed to provide mold strength during mold construction. Second, it is understood by the inventors that calcium monoaluminate experiences a very low rate of reaction with titanium and titanium aluminide based alloys. In a certain embodiment, calcium monoaluminate is provided to the core composition of the present disclosure in the form of calcium aluminate particles. In one aspect, the core composition comprises a mixture of calcium aluminate particles and alumina, for example, hollow aluminum oxide.

In one aspect of the disclosure, the core composition provides minimum reaction with the alloy during casting, and the mold provides hollow castings with the required component properties. External properties of the casting include features such as shape, geometry, and surface finish. Internal properties of the casting include mechanical properties, microstructure, defects (such as pores and inclusions) below a specified size and within allowable limits.

The percentage of solids in the initial calcium aluminate (liquid particle mixture) and the solids in the final calcium aluminate are a feature of the present disclosure. In one example, the percentage of solids in the initial calcium aluminate-liquid particle mix is from about 65% to about 80%. In one example, the percentage of solids in the initial calcium aluminate-liquid particle mix is from about 70% to about 80%. In another example, the solids in the final calcium aluminate-liquid particle mix that is calcium aluminate particles with less than about 50 microns in outside dimension and large scale alumina particles that are larger than about 70 microns—is from about 75% to about 90%. The initial calcium aluminate particles are fine scale, in one example about 5 microns to about 50 microns, and alumina particles of greater than about 70 microns are mixed with water to provide a uniform and homogeneous slurry. In some cases, the final mix is formed by adding progressively larger scale alumina particles, for example 70 microns at first and then 150 microns, to the initial slurry and mixing for between 2 and 15 minutes to achieve a uniform mix.

The composition of one aspect of the present disclosure provides for low-cost casting of hollow titanium aluminide (TiAl) turbine blades, for example, TiAl low pressure turbine blades. The composition may provide the ability to cast near-net-shape parts that require less machining and/or treatment than parts made using conventional shell molds and gravity casting. As used herein, the expression "near-net-shape" implies that the initial production of an article is close to the final (net) shape of the article, reducing the need for further treatment, such as, extensive machining and surface finishing. As used herein, the term "turbine blade" refers to both steam turbine blades and gas turbine blades.

The inventors of the instant application have discovered technology for producing hollow titanium alloy and titanium aluminide alloy castings. The present disclosure provides, inter alia, a composition of matter for producing cores for investment casting molds for titanium alloys, and a casting process that can provide hollow components of titanium and titanium alloys. One of the technical advantages of this disclosure is that, in one aspect, the disclosure may improve the structural integrity of net shape casting that can be generated, for example, from calcium aluminate particles and alumina investment molds and such molds containing cores. The higher strength, for example, higher fatigue strength, allows lighter hollow components to be fabricated. In addition, components having higher fatigue strength can last longer, and thus have lower life-cycle costs.

The present disclosure provides a core composition for investment casting molds for titanium alloys, methods for making the cores, casting molds containing the cores, and methods for casting hollow titanium alloy components, including turbine blades, using the cores. The core composition comprises, in one example, calcium aluminate and alumina particles, for example hollow alumina particles. The calcium aluminate particles provide the core with the ability to withstand reaction of the ceramic with the molten titanium alloy.

The hollow alumina particles provide the core with compliance and crushability; these are desired properties because it is necessary that the core does not impose excessive tensile stress on the casting during post solidification cooling. Typically the core material has a lower thermal expansion coefficient than the metal, and the metal cools more quickly than the ceramic. If the core is too strong, the core will impose tensile stress on the part because the part shrinks more quickly than the core during post solidification cooling. Hence, a feature of the present disclosure is a core that is crushed during cooling, such that it does not impose excessive tensile stress on the part and generate tensile tears, cracks, and defects. The results show a slab mold that contains a core with platinum pins holding the core suspended in the mold (see FIGS. 13-15).

Wax is first prepared for making a slab with a core positioned inside the resulting slab wax. In order to make the cored slab for evaluation tests, a conventional slab wax was generated and a section of the wax at the end of the slab was removed. The end surfaces of the slab were then reconstructed using sheet wax that was joined to the end of the slab leaving the end surface of the slab wax exposed. The red wax on the top of the slab wax is a riser that is employed to accommodate solidification shrinkage in the slab casting.

Figure 2:
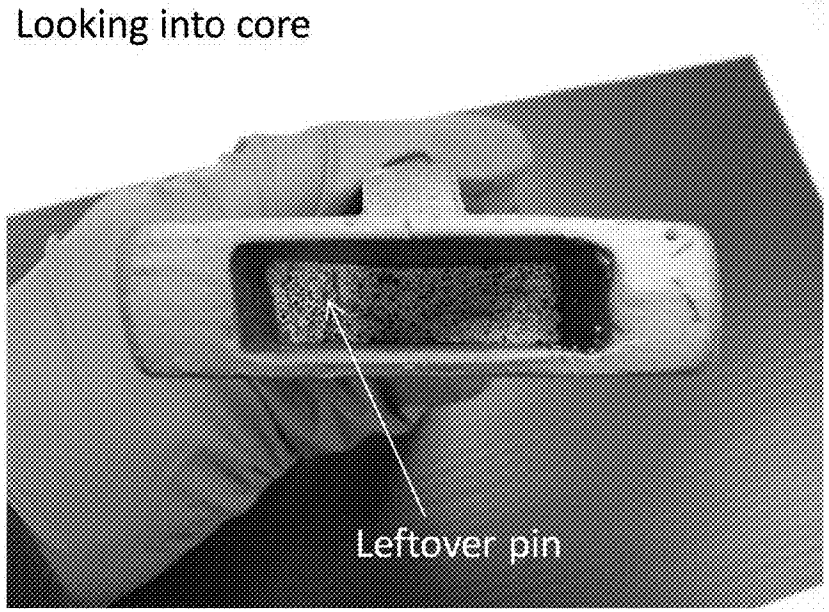
FIG. 2 shows a cavity in the casting and part of the arrangement of the platinum pins. The casting was cut and the core in the casting was partially removed to examine the condition of the inner surface of the casting; the remainder of the core can also be seen inside the casting. The platinum pins can be seen crossing the cavity in the photo. The platinum pins hold the core in place during casting. After casting, the platinum pins become embedded in the casting.
Figure 5:
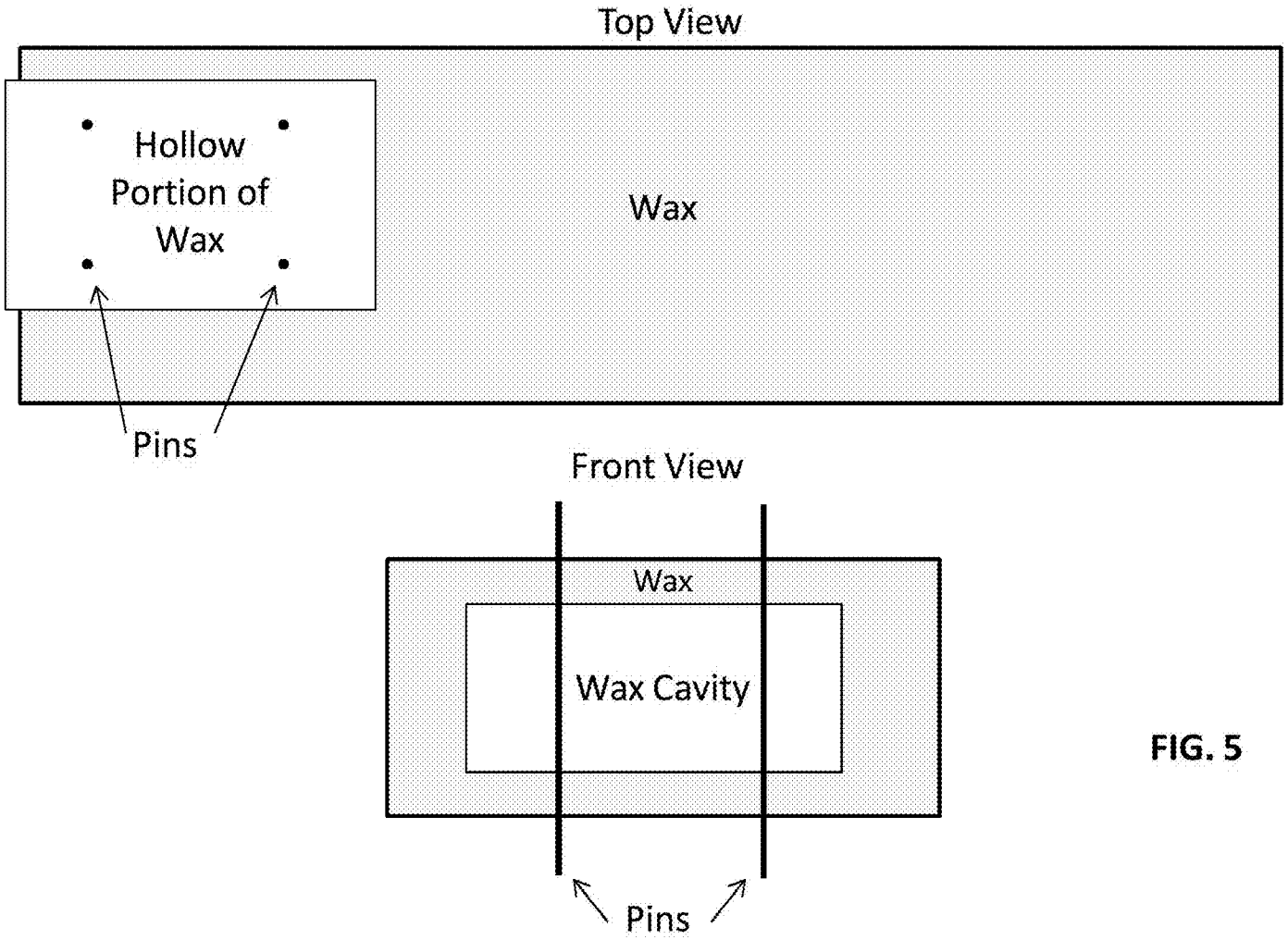
FIGS. 5 and 6 show drawings of the arrangement of the wax and the disposition of the cavity for the core in the wax. See FIG. 4 for additional details.
Figure 6:
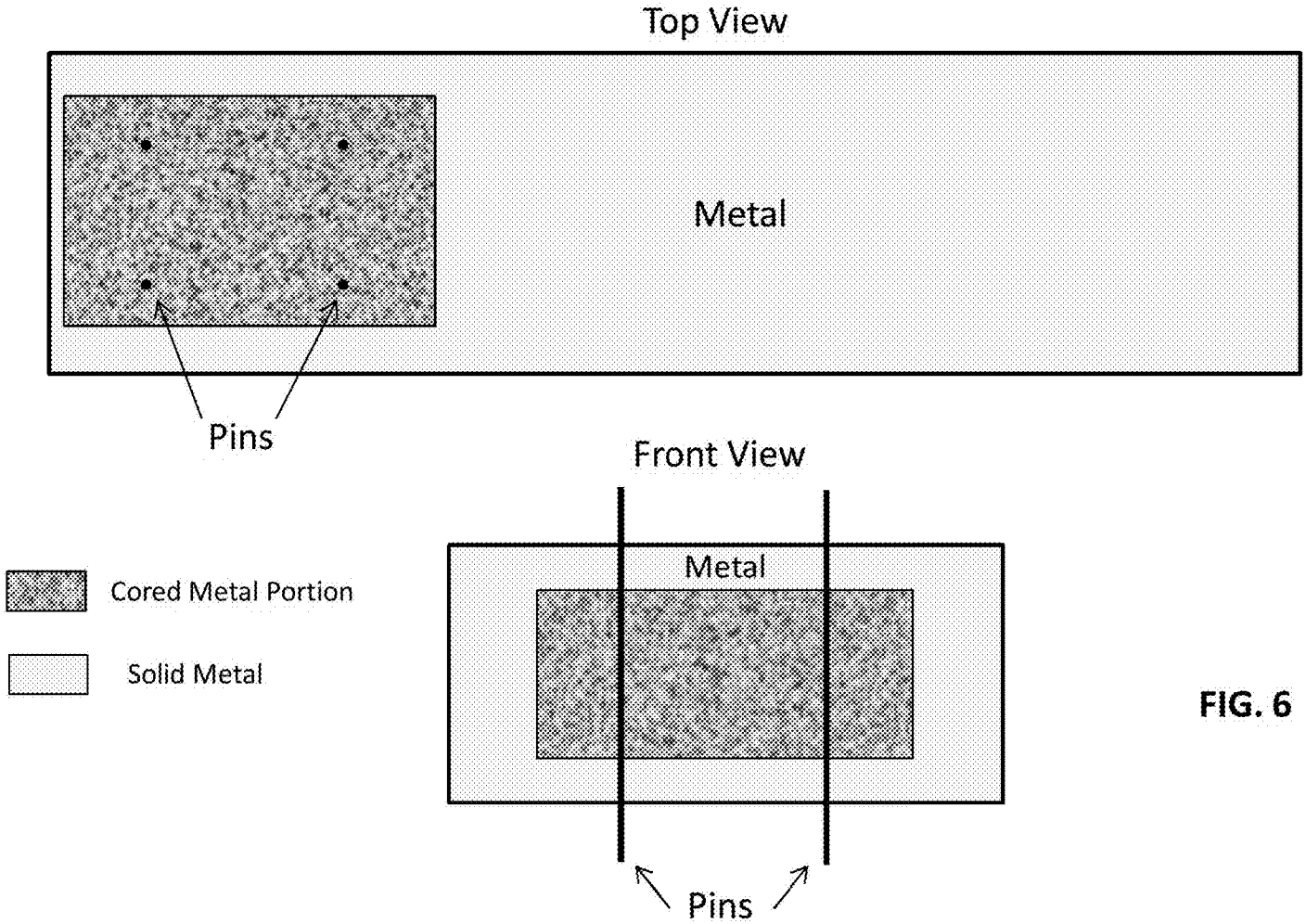

Platinum pins were then inserted perpendicular to the sides of the slab through the sheet wax and across the cavity. The platinum pins were arranged so that they penetrated both sides of the slab wax and they were supported in the cavity by the sheet wax on each side. The cavity and the arrangement of the platinum pins are shown for example in FIGS. 2, 5 and 6. In one example, the platinum pins can be seen crossing the cavity. The calcium aluminate containing core material was then added to the cavity and cured. The platinum pins hold the core in place during casting. After casting, the platinum pins become embedded in the casting.

After the wax pattern was prepared, a casting mold was made. The casting molds were cured for a period of approximately 24 hours. After curing, the wax was removed. After the mold was cured and the wax was removed, the core in the slab was left suspended in the mold cavity and supported by the platinum pins. The green mold with the core was then fired at a temperature above 600 degrees Celsius for a time period in excess of 1 hour, in one example 2 to 6 hours, to develop sufficient core and mold strength for casting and to remove any undesirable residual impurities in the core and mold. In one example, the firing temperature is 600 degrees Celsius and the period of time is about four hours. In one embodiment, the core is fired separately and can then be assembled with the wax for the mold, and then the mold can be invested using the ceramic mix formulation.

Figure 1:
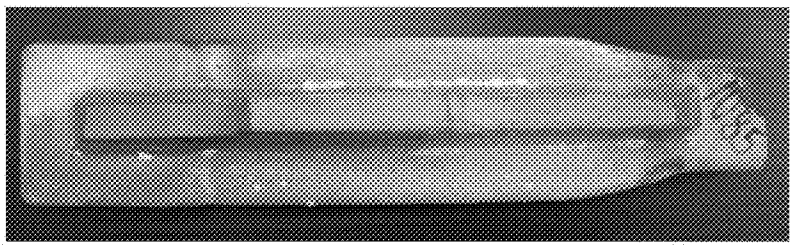
FIG. 1 shows a typical slab casting that was used to develop the core composition of the present disclosure. The slab is a simple geometry with a pour cup and a riser to allow for solidification shrinkage.
Figure 1:
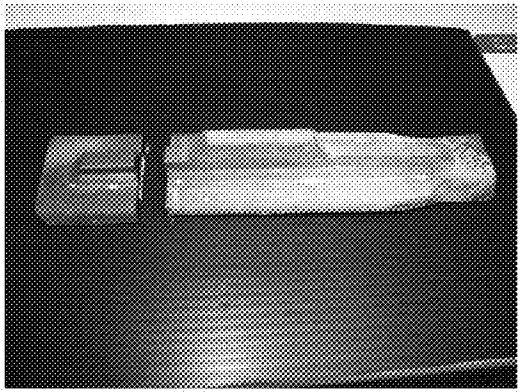
Figure 3:
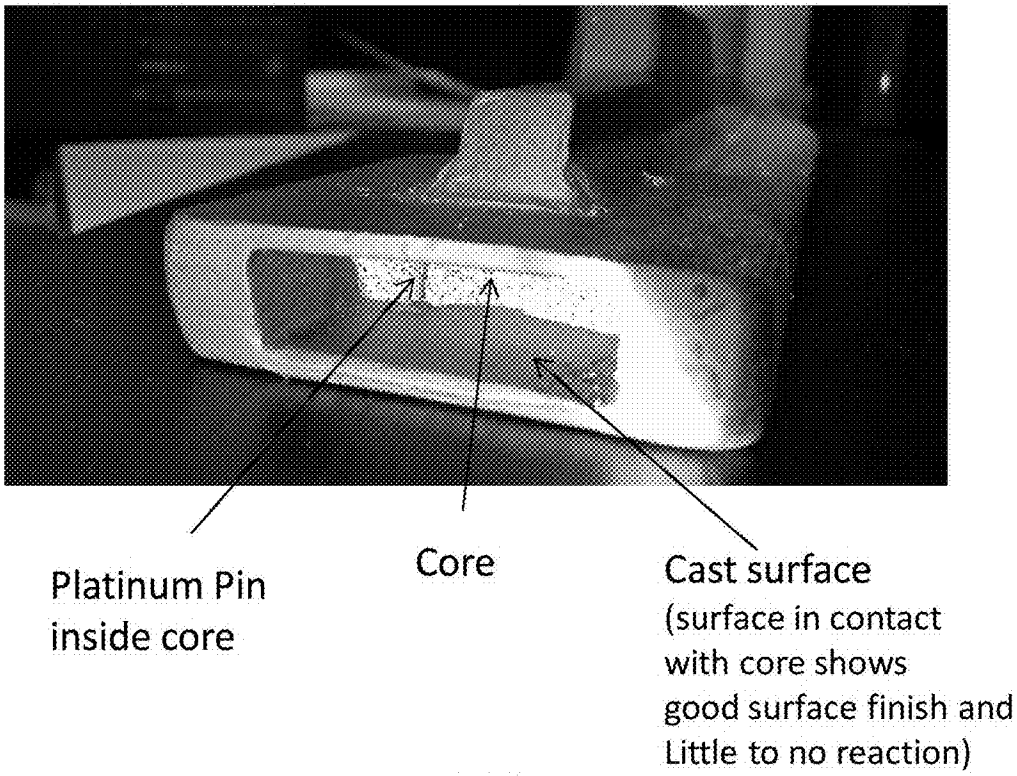
FIG. 3 shows the cavity in a casting and part of the arrangement of the platinum pins. In the region where the core has been removed, the platinum pins can be seen across the cavity in the attached photos.
Figure 7:
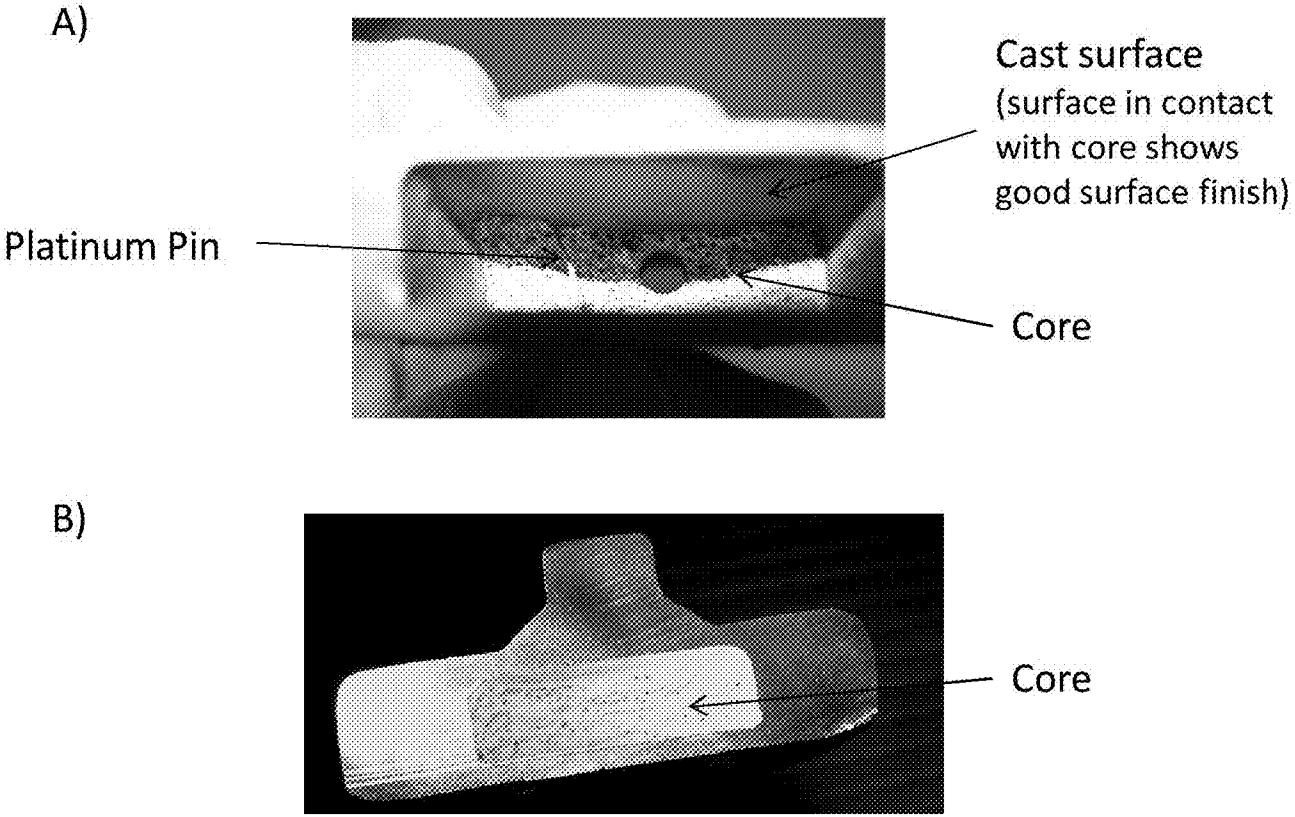
FIG. 7 shows the cut surface of the transverse section of a titanium aluminide alloy casting that contains a calcium aluminate-containing core. It can be seen in FIG. 7 that there is essentially no reaction between the casting and the calcium aluminate-containing core. The core has been partially removed.
Figure 8:
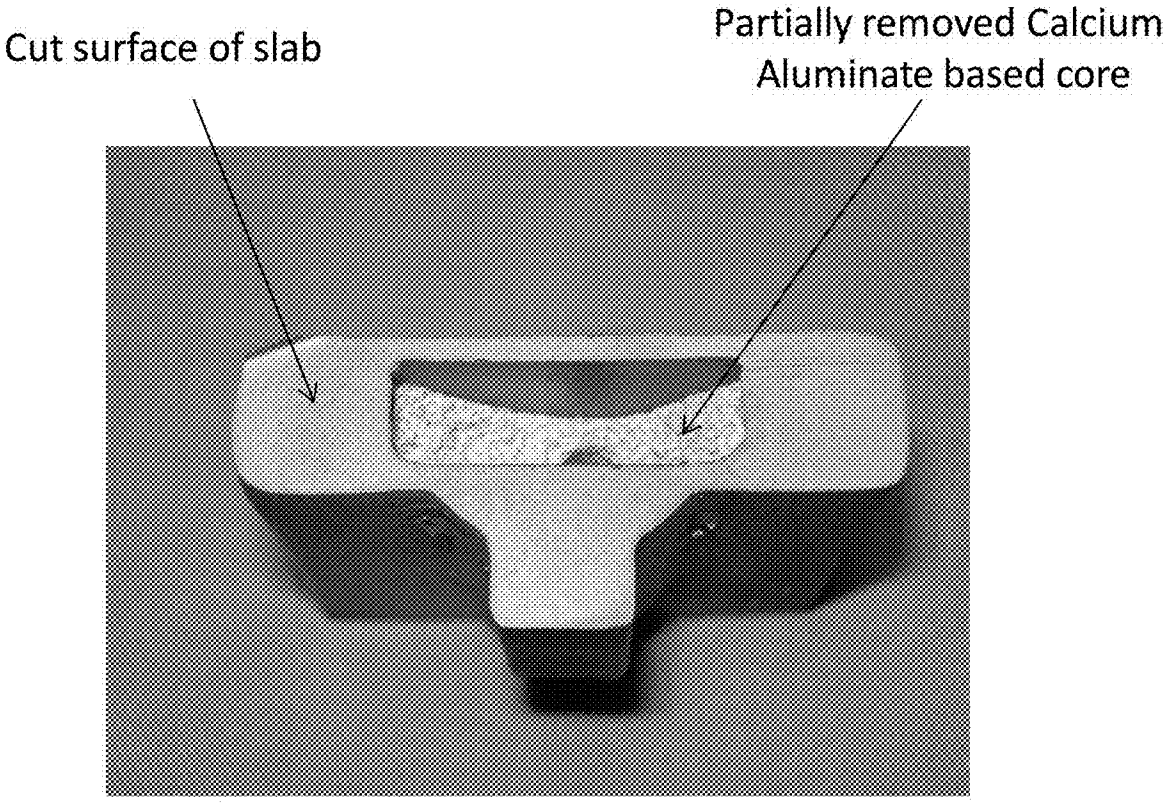
FIG. 8 shows a titanium alloy (titanium aluminide) slab casting that was produced using the mold with the core within the mold. It shows the sliced core slab, showing transverse sections that allow the calcium aluminate containing core to be observed directly. The core was partially removed by grit blasting, and the internal surface of the casting can be observed. A region of the casting with the core partially removed can be seen. The internal surface of the casting that was generated by the core can be seen to be of high quality. The surface is smooth (it had a surface roughness of an Ra value of less than 100), and shows minimal if any evidence of reaction with the core material during the casting operation.
Figure 9:
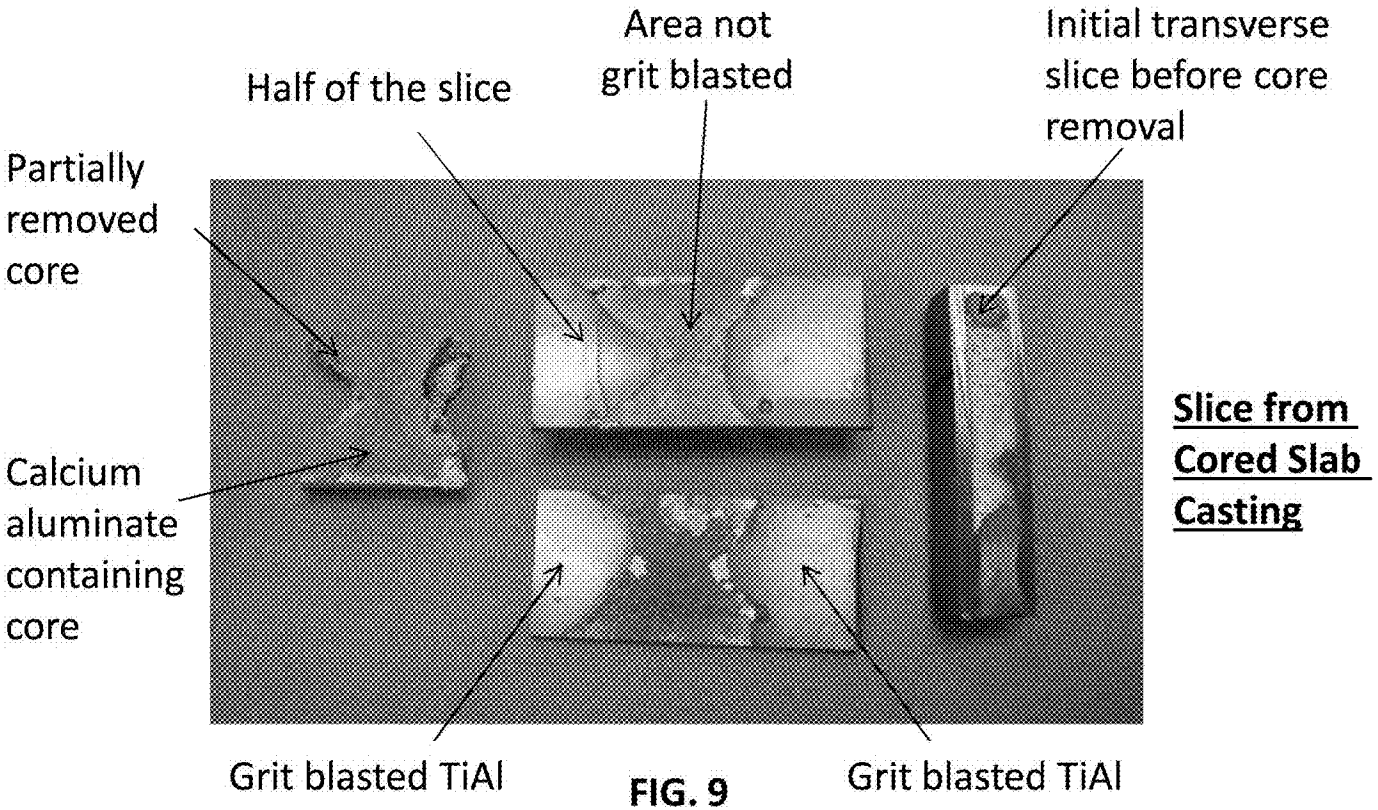
Figure 10:
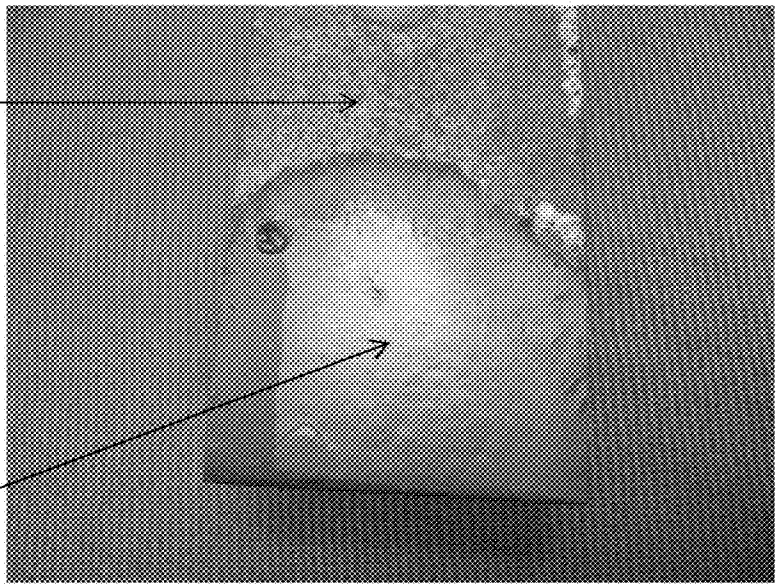
Figure 11:
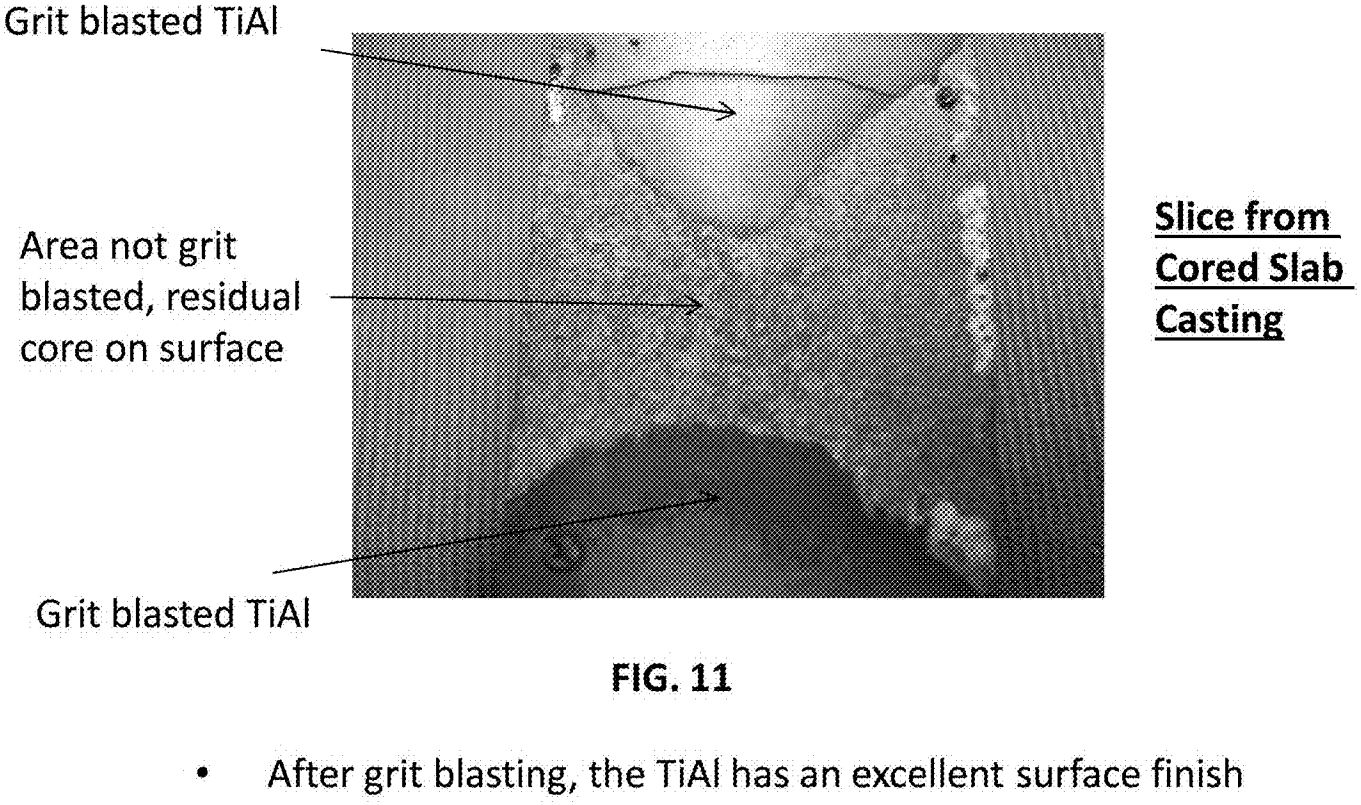
Figure 12:
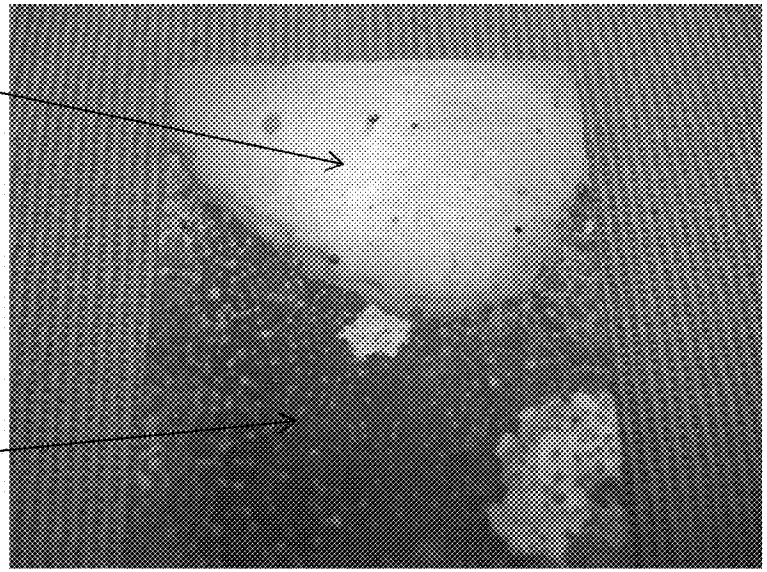

FIG. 1 shows the resulting titanium alloy (titanium aluminide) slab casting that was produced using the mold with the core within the mold. A region of the casting with the core partially removed can be seen in FIGS. 2 and 3. The internal surface of the casting that was generated by the core can be seen in FIG. 3. This internal surface of the casting was shown to be of high quality; that is, the surface of the internal surface is smooth (it had a surface roughness of a Ra value of less than 100), and showed little evidence of aggressive reaction with the core material during the casting operation. The platinum pins used to support the core during mold making and casting can also be seen in several pictures (see FIGS. 2, 5 and 13). FIGS. 7 and 8 show the casting after it has been cut in a transverse direction relative to the longitudinal axis of the blade. Blades have also been produced with a calcium aluminate-containing core in them. An example of a titanium aluminide blade casting is shown in FIG. 16.

The diameter of the platinum pins that are supporting the core is one feature of the present disclosure. The inventors of the instant application have discovered that if the diameter of the pins is too small (less than about 2 mm need to correct this) and the unsupported length is too long, the pins will deform during firing and the position of the core in the mold will not be retained. If the core position moves in the mold, the dimensions of the hollow cavity within the cast component will not be controlled correctly and the part will be rejected. In certain embodiments, the diameter of the platinum pins can range from about 0.1 mm to about 4 mm.

On the other hand, if the diameter of the pins is too large (greater than about 2 mm), they will remain as defects in the final casting after heat treatment and they reduce the fatigue-resistant properties of the component. The inventors of the present disclosure discovered that platinum pins, or platinum alloy pins, are preferred to stabilize the core in the mold prior to casting and during mold filling. Platinum is preferred for its strength and oxidation resistance. After casting and heat treatment, the pins are homogenized into the structure such that the mechanical property requirements are maintained or improved. The platinum pins are, therefore, in one example about 2 mm in diameter. In one example, the inventors secured the mold with one 20 mm long platinum pin (see FIG. 14). In another example, the inventors twisted two 13 mm long platinum pins together and used this to secure the mold (see FIG. 15). As such, in one example, platinum or platinum alloy pins are used that are about 10 to about 30 mm in length and are about 2 mm in diameter. One or more platinum pins may be used. In another example, the platinum pins are placed in order to maximize the security of the core in the mold, for example placing platinum pins in varying configurations of for example, crossing or parallel configurations.

The weight fraction of calcium aluminate particles in the core is a feature of the present disclosure. In one embodiment, the weight fraction of calcium aluminate particles is from about 20% to about 80%. In one embodiment, the weight fraction of calcium aluminate particles is from about 20% to about 60%. In one embodiment, the weight fraction of calcium aluminate particles is from about 20% to about 40%. In one embodiment, the weight fraction of calcium aluminate particles is from about 40% to about 60%. In one embodiment, the weight fraction of calcium aluminate particles is from about 55% to about 65%.

In one embodiment, the weight fraction of calcium aluminate particles is about 40%. In one embodiment, the weight fraction of calcium aluminate particles is about 50%. In one embodiment, the weight fraction of calcium aluminate particles is about 60%. In one embodiment, the weight fraction of calcium aluminate particles is about 70%. In one embodiment, the weight fraction of calcium aluminate particles is about 80%.

The particle size of the calcium aluminate particles used in the core formulation is yet another feature of the present disclosure because this has a significant effect on the surface finish of the internal surfaces of the hollow casting and the strength of the core. In one example, the particle size of the calcium aluminate particles is less than about 50 microns. In another example, the mean particle size of the calcium aluminate particles is less than about 10 microns. In one embodiment, the particle size is measured as the outside dimension of the particle. The calcium aluminate particles can be from about 5 microns to about 50 microns in outside dimension.

The inventors of the instant disclosure have discovered that a core composition can be made with beneficial properties and that combination of fine scale calcium aluminate particles with large scale hollow particles for the core provide for improved results. These fine scale particles of calcium aluminate can be from about 2 microns to about 40 microns in outside dimension. In one example, the calcium aluminate particles used in the core composition can be from about 10 microns to about 30 microns. In another example, the calcium aluminate particles are from about 20 microns to about 40 microns in outside dimension. In one embodiment, the calcium aluminate particles are about 5 microns in outside dimension. In one embodiment, the calcium aluminate particles are about 10 microns in outside dimension. In one embodiment, the calcium aluminate particles are about 20 microns in outside dimension. In one embodiment, the calcium aluminate particles are about 30 microns in outside dimension. In one embodiment, the calcium aluminate particles are about 40 microns in outside dimension. In one embodiment, the calcium aluminate particles are about 50 microns in outside dimension.

A calcium aluminate particle size of less than about 50 microns is preferred for the core for three reasons: first, the fine particle size is believed to promote the formation of hydraulic bonds during curing; second, the fine particle size is understood to promote inter-particle sintering during firing, and this can increase the mold strength; and third, the fine particle size is believed to improve the surface finish of the cast article produced in the mold. The calcium aluminate particles may be provided as powder, and can be used either in its intrinsic powder form, or in an agglomerated form, such as, as spray dried agglomerates. The calcium aluminate particles can, in one example, also be pre-blended with large-scale (for, example, more than about 70 micron in size) alumina. The alumina is believed to provide an increase in strength due to sintering during high-temperature firing. In certain instances, fine-scale alumina (that is, less than 50 microns in size) may also be added with or without the large-scale alumina. In one embodiment, the calcium aluminate particles are of high purity and also contain up to 70% alumina.

The calcium aluminate particles are designed and processed to have a minimum quantity of impurities, such as, minimum amounts of silica, sodium and other alkali, and iron oxide. In one aspect, the target level for the calcium aluminate particles is that the sum of the $Na_2O$, $SiO_2$, $Fe_2O_3$, and $TiO_2$ is less than about 2 weight percent. In one embodiment, the sum of the $Na_2O$, $SiO_2$, $Fe_2O_3$, and $TiO_2$ is less than about 0.05 weight percent.

In one aspect, the mold composition, for example the investment mold composition, or the core composition, may comprise a mixture of fine scale calcium aluminate particles and large scale hollow alumina particles. The calcium aluminate particles may function as a binder, for example, the calcium aluminate particles may provide the main skeletal structure of the mold and core structure. The calcium aluminate particles may comprise a continuous phase in the mold and core and provide strength during curing, and casting. The core composition may consist of fine scale calcium aluminate particles and large scale hollow alumina particles, that is, calcium aluminate and large scale alumina particles may comprise substantially the only components of the core composition, with little or no other components.

The weight fraction of the large particles, for example alumina bubble (or hollow alumina particles), in the core is another feature of the present disclosure, as this determines compliance and crushability. In one embodiment, the weight fraction of large scale particles is at least 20%. In another embodiment, the weight fraction of large scale particles is about 20% to about 65%. These large scale particles can be hollow, for example hollow alumina particles of greater than 70 microns in outside dimension. Alternatively, the weight fraction of the large scale particles is from about 20% to about 45%. In one embodiment, the weight fraction of the large scale particles is from about 20% to about 35%. In one embodiment, the weight fraction of the large scale particles is from about 20% to about 30%. In one embodiment, the weight fraction of the large scale particles is from about 30% to about 50%. The weight fraction of the large scale particles is, in another example, about 20%. In one embodiment, the weight fraction of the large scale particles is about 30%. In one embodiment, the weight fraction of the large scale particles is about 40%. In one embodiment, the weight fraction of the large scale particles is about 50%. In one embodiment, the weight fraction of the large scale particles is about 60%. The large scale particles used in the present disclosure are, in one example, hollow particles of alumina.

The particle size of the large scale particles used in the core formulation is yet another feature of the present disclosure. In one example, the particle size of large scale particles is about 70 microns to about 1000 microns in outside dimension. In another example, the mean particle size of the large scale particles is more than 70 microns. In one embodiment, the particle size is measured as the outside dimension of the particle. The large scale particles can be from about 70 microns to about 200 microns in outside dimension. The inventors of the instant disclosure have discovered that a core composition can be made with beneficial properties and that the combination of fine scale calcium aluminate particles with large scale hollow particles provide for superior results.

These large scale particles can be from about 70 microns to about 150 microns in outside dimension. In one example, the large scale particles used in the core composition can be from about 100 microns to about 200 microns. In another example, the large scale particles are from about 150 microns to about 1000 microns in outside dimension. In one embodiment, the large scale particles are about 100 microns in outside dimension. In one embodiment, the large scale particles are about 150 microns in outside dimension. In one embodiment, the large scale particles are about 200 microns in outside dimension. In one embodiment, the large scale particles are about 1000 microns in outside dimension.

These large scale particles may comprise hollow oxide particles. The large scale particles may comprise aluminum oxide particles, magnesium oxide particles, calcium oxide particles, zirconium oxide particles, titanium oxide particles, or combinations thereof. The large scale particles can be a ceramic, such as calcium aluminate, calcium hexaluminate, zirconia, or combinations thereof. In one embodiment, the oxide particles may be a combination of one or more different oxide particles. In a particular example, the large scale particles are hollow oxide particles, and in a related example these large scale particles comprise hollow aluminum oxide spheres or bubbles. In one embodiment, the present disclosure comprises a hollow titanium-containing article casting-mold composition comprising calcium aluminate. In another embodiment, the casting-mold composition further comprises oxide particles, for example, hollow oxide particles.

In certain embodiments, the hollow oxide particles may comprise hollow alumina spheres (in one example, greater than 100 microns in diameter, for example, about 1000 microns). The hollow alumina spheres may be incorporated into the casting-mold or core composition, and the hollow spheres may have a range of geometries, such as, round particles, or irregular aggregates. In certain embodiments, the alumina may include both round particles and hollow spheres. In one aspect, these geometries were found to increase the fluidity of the investment mold mixture. The enhanced fluidity may typically improve the surface finish and fidelity or accuracy of the surface features of the final casting produced from the mold.

The core composition can further include aluminum oxide, for example, in the form of hollow particles. In one example, these particles have a hollow core or a substantially hollow core substantially surrounded by an oxide. These hollow aluminum oxide particles may comprise about 99% of aluminum oxide and have about 10 millimeter [mm] or less in outside dimension, such as, width or diameter. In one embodiment, the hollow aluminum oxide particles have about 1 millimeter [mm] or less in outside dimension, such as, width or diameter. In another embodiment, the aluminum oxide comprises particles that may have outside dimensions that range from about 70 microns [μm] to about 10,000 microns. In another embodiment, the aluminum oxide comprises particles that may have outside dimensions that range from about 70 microns [μm] to about 1000 microns.

The particular size of the particles is a feature of the present disclosure. The combination of fine or small scale particles of calcium aluminate and hollow large scale particles is one feature of the present disclosure. The calcium aluminate particles may comprise particles of up to about 50 microns in outside dimension, and these fine scale particles are combined with the large scale particles comprising particles of from about 70 to about 1000 microns in outside dimension. At least 50% of the calcium aluminate particles are, in one example, less than about 10 microns in outside dimension. In one example, at least 50% of the calcium aluminate particles are less than about 25 microns in outside dimension.

The particle size distributions of both the calcium aluminate particles and large scale particles, for example alumina bubble/large particles, are one feature of the present disclosure and play a role in controlling the linear shrinkage on firing. In addition, factors including characteristics of calcium aluminate particles and large scale particles, e.g. alumina particles, and the firing cycle (e.g., the temperature, time, humidity) are also features of the present disclosure.

The density of the core is a feature of the present disclosure. The density affects the strength/crushability of the core, and the ability of the core to be removed from the hollow casting by methods, such as leaching, and specifically preferential leaching. Preferential leaching involves removal of the ceramic core from the casting without removal of the casting itself. In one embodiment, the density of the core is from about 0.8 g/cc to about 3 g/cc. In one embodiment, the density of the core is about 1.5 g/cc. The inventors discovered that if the core density is too low, the core does not have sufficient strength to withstand the stresses during mold making and casting. If the core density is too high, the core removal from the casting is difficult.

The shrinkage of the core on firing plays a role in controlling core dimensions. With the selected ratios of the weight fractions of fine-scale calcium aluminate particles and large scale particles, such as alumina particles, the core shrinkage can be reduced to less than about 1.0% in some embodiments. With improved formulations, the shrinkage of the core on firing can be reduced to less than about 0.75%, with the use of a weight percentage of large scale particles of more than about 30%, due to the low sintering characteristics of the large scale particles.

The instant disclosure also teaches a method of making a ceramic core. The cores can be made by a range of molding methods including dry pressing (followed by sintering, injection molding (with a binder such as a wax or polymer)), gel casting, or slurry casting. In one example, the present disclosure provides for three ways by which to make the core: First, mix powder of fine-scale calcium aluminate and large scale alumina and dry press the powder mix using a compaction die and sinter. Second, injection molding a mix powder of fine-scale calcium aluminate and large scale alumina with a wax as a binder/lubricant. Third, pouring a slurry of the fine-scale calcium aluminate and large scale alumina into a die, as described in more detail below.

The ceramic core is made by combining calcium aluminate particles with large scale particles and a liquid to form a slurry and then introducing this slurry into a die to produce a green product of an article-shaped body. Subsequently, the green product is heated to make the ceramic core. For making the ceramic core, fine scale calcium aluminate particles may be used along with large scale particles that are substantially hollow, for example large scale hollow particles of aluminum oxide that are more than about 70 microns in outside dimension.

The method of making the ceramic core may include introducing oxide particles to the slurry before introducing the slurry into an article-shaped body. These oxide particles comprise, in one example, hollow oxide particles. The ceramic core can be made using hollow oxide particles and/or hollow alumina spheres. These large scale particles may be hollow or substantially hollow.

The initial slurry is mixed to have a viscosity of between 50 and 150 centipoise. In one embodiment, viscosity range is between 80 and 120 centipoise. If the viscosity is too low, the slurry will not maintain all the solids in suspension, and settling of the heavier particles will occur and lead to segregation during curing. If the viscosity is too high, the calcium aluminate particles cannot partition to the fugitive pattern. The final slurry with the calcium aluminate particles and the hollow large scale particles (for example, hollow alumina particles) is mixed to have a viscosity of between approximately 2000 and 8000 centipoise. In one embodiment, this final slurry viscosity range is between 3000 and 6000 centipoise. If the final slurry/mix viscosity is too high, the final slurry mix will not flow around the fugitive pattern, and the internal cavity of the mold will not be suitable for casting the final required part. If the final slurry mix viscosity is too low, settling of the heavier particles will occur during curing, and the mold will not have the required uniform composition throughout the core, and the quality of the resulting casting will be compromised.

The solids loading of the initial slurry and the solids loading of the final mold mix have effects on the core structure. The percentage of solids loading is defined as the total solids in the mix divided by the total mass of the liquid and solids in the mix, described as a percentage. In one embodiment, the percentage of solids in the initial calcium aluminate-liquid mix is about 71 percent to 78 percent.

If the solids loading in the initial calcium aluminate slurry is less than about 70 percent, then the particles will not remain in suspension and during curing of the mold the particles will separate from the water and the composition will not be uniform throughout the mold. In contrast, if the solids loading is too high in the cement (for example greater than about 78 percent), the viscosity of the final mix with the large-scale alumina will be too high (for example greater than about 85%, depending on the amount, size, and morphology of the large-scale alumina particles that are added), and the calcium aluminate particles in the mix will not be able to partition to the fugitive pattern within the mold.

In one embodiment, the percentage of solids in the final calcium aluminate-liquid mix with the large-scale (meaning greater than about 70 microns) alumina particles is about 75 percent to about 90 percent. In one embodiment, the percentage of solids in the final calcium aluminate-liquid mix with the large-scale alumina particles is about 78 percent to about 88 percent. In another embodiment, the percentage of solids in the final calcium aluminate-liquid mix with the large-scale alumina particles is about 78 percent to about 84 percent. In a particular embodiment, the percentage of solids in the final calcium aluminate-liquid mix with the large-scale alumina particles is about 80 percent.

The alumina can be incorporated as alumina particles, for example hollow alumina particles. The particles can have a range of geometries, such as round particles, or irregular aggregates. The alumina particle size can be as small as 10 microns and as large as 10 mm. In one embodiment, the alumina consists of both round particles and hollow particles, since these geometries increase the fluidity of the investment mold mixture.

The fluidity impacts the manner in which the calcium aluminate particles partition to the fugitive pattern (such as a wax) during pouring and setting of the investment mold mix around the fugitive pattern. The fluidity affects the surface finish and fidelity of the surface features of the final casting produced from the mold.

By hollow, it is contemplated that these large scale particles are particles that have space or pockets of air within the particle(s) such that the particle is not a complete, packed dense particle. The degree of this space/air varies and hollow particles include particles where at least 20% of the volume of the particle is air. In one example, hollow particles are particles where about 5% to about 75% of the volume of the particle is made up of empty space or air. In another example, hollow particles are particles where about 10% to about 80% of the volume of the particle is made up of empty space or air. In yet another example, hollow particles are particles where about 20% to about 70% of the volume of the particle is made up of empty space or air. In another example, hollow particles are particles where about 30% to about 60% of the volume of the particle is made up of empty space or air. In another example, hollow particles are particles where about 40% to about 50% of the volume of the particle is made up of empty space or air.

In another example, hollow particles are particles where about 10% of the volume of the particle is made up of empty space or air. In one example, hollow particles are particles where about 20% of the volume of the particle is made up of empty space or air. In one example, hollow particles are particles where about 30% of the volume of the particle is made up of empty space or air. In one example, hollow particles are particles where about 40% of the volume of the particle is made up of empty space or air. In one example, hollow particles are particles where about 50% of the volume of the particle is made up of empty space or air. In one example, hollow particles are particles where about 60% of the volume of the particle is made up of empty space or air. In one example, hollow particles are particles where about 70% of the volume of the particle is made up of empty space or air. In one example, hollow particles are particles where about 80% of the volume of the particle is made up of empty space or air. In one example, hollow particles are particles where about 90% of the volume of the particle is made up of empty space or air.

The hollow particles, for example hollow large scale alumina particles, serve at least two functions: [1] they reduce the density and the weight of the core, with minimal reduction in strength; strength levels of approximately 500 psi and above are obtained, with densities of approximately 2 g/cc and less; and [2] they reduce the elastic modulus of the mold and help to provide compliance during cool down of the mold and the component after casting. The increased compliance and crushability of the mold may reduce the tensile stresses on the component.

FIGS. 2, 3, 7 and 8 show sections of the slab casting. The sections allow the calcium aluminate containing core to be observed directly; a range of difference sections of the casting and the core can be seen. The cores can be made by a range of molding methods including dry pressing (followed by sintering, injection molding (with a binder such as a wax or polymer)), gel casting, or slurry casting.

The inventors here also teach a sintered ceramic core for use in casting a titanium-containing article. The core comprises calcium aluminate particles and large scale particles. The calcium aluminate particles are small scale and the large scale particles may be hollow. The core is substantially free of silica after it is sintered. Before sintering, in one example, the ceramic core comprises hollow alumina particles, and after sintering the core comprises no more than about 0.5% by weight (based on the total weight of the core) of free silica.

In FIG. 8, the core was partially removed by grit blasting, and the internal surface of the casting can be observed. In FIG. 7, the partially removed core can be seen at higher magnification, and the internal surface of the casting can be observed in greater detail. It is also possible to see one of the platinum pins that was used to support the core in the mold. The platinum pins were not completely removed during casting. The casting is being observed in the as-cast condition; it has not been subjected to any heat treatment.

The condition of the internal surface of the casting that has been generated by the calcium aluminate-containing core was shown to be acceptable. In the grit blasted condition, the Ra value was from about 10 to about 50, without further conditioning. FIGS. 7 and 8 show various sections of the core and casting; the integrity of the core was maintained with little to no reaction between the core and the casting.

Surface roughness is one of the indices representing the surface integrity of cast and machined parts. Surface roughness is characterized by the centerline average roughness value "Ra", as well as the average peak-to-valley distance "Rz" in a designated area as measured by optical profilometry. A roughness value can either be calculated on a profile or on a surface. The profile roughness parameter (Ra, Rq, . . . ) are more common Each of the roughness parameters is calculated using a formula for describing the surface. There are many different roughness parameters in use, but $R_a$ is by far the most common. As known in the art, surface roughness is correlated with tool wear. Typically, the surface-finishing process though grinding and honing yields surfaces with Ra in a range of 0.1 mm to 1.6 mm. The surface roughness Ra value of the final coating depends upon the desired function of the coating or coated article.

The average roughness, Ra, is expressed in units of height. In the Imperial (English) system, 1 Ra is typically expressed in "millionths" of an inch. This is also referred to as "microinches". The Ra values indicated herein refer to microinches. An Ra value of 70 corresponds to approximately 2 microns; and an Ra value of 35 corresponds to approximately 1 micron. It is typically required that the surface of high performance articles, such as turbine blades, turbine vanes/nozzles, turbochargers, reciprocating engine valves, pistons, and the like, have an Ra of about 20 or less. One aspect of the present disclosure is a turbine blade comprising titanium or titanium alloy and having an average roughness, Ra, of less than 20 across at least a portion of its surface area.

As the molten metals are heated higher and higher, they tend to become more and more reactive (e.g., undergoing unwanted reactions with the mold surface). Such reactions lead to the formation of impurities that contaminate the metal parts, which result in various detrimental consequences. The presence of impurities shifts the composition of the metal such that it may not meet the desired standard, thereby disallowing the use of the cast piece for the intended application. Moreover, the presence of the impurities can detrimentally affect the mechanical properties of the metallic material (e.g., lowering the strength of the material).

Furthermore, such reactions can lead to surface texturing, which results in substantial, undesirable roughness on the surface of the cast piece. For example, using the surface roughness value Ra, as known in the art for characterizing surface roughness, cast pieces utilizing stainless steel alloys and/or titanium alloys typically exhibit an Ra value between about 100 and 200 under good working conditions. These detrimental effects drive one to use lower temperatures for filling molds. However, if the temperature of the molten metal is not heated enough, the casting material can cool too quickly, leading to incomplete filling of the cast mold.

The disclosure is also directed to a mold composition for casting a hollow titanium-containing article, comprising calcium aluminate particles; and the ceramic core as taught herein. The calcium aluminate particles of the core composition comprise three phases: calcium monoaluminate ($CaAl_2O_4$), calcium dialuminate ($CaAl_4O_7$), and mayenite ($Ca_{12}Al_{14}O_{33}$). The calcium monoaluminate in the calcium aluminate particles in the core composition has three advantages over other calcium aluminate phases: 1) the calcium monoaluminate is incorporated in the core because it has a fast setting response (although not as fast as mayenite) and it is believed to provide the core with strength during the early stages of curing. The rapid generation of core strength provides dimensional stability of the casting core, and this feature improves the dimensional consistency of the final cast component. 2) The calcium monoaluminate is chemically stable with regard to the titanium and titanium aluminide alloys that are being cast. The calcium monoaluminate is preferred relative to the calcium dialuminate, and other calcium aluminate phases with higher alumina activity; these phases are more reactive with titanium and titanium aluminide alloys that are being cast. 3) The calcium monoaluminate and calcium dialuminate are low expansion phases and are understood to prevent the formation of high levels of stress in the mold and the core during curing, dewaxing, and subsequent casting. The thermal expansion behavior of calcium monoaluminate is a close match with alumina.

Furthermore, the present disclosure also teaches a method for making a casting mold and a casting core for casting a hollow titanium-containing article. The method comprises combining calcium aluminate particles, large scale particles and a liquid to produce a slurry, introducing this slurry into a vessel for making the mold that contains a fugitive pattern, and allowing it to cure in the vessel. In one embodiment, platinum pins are positioned to span the wax that generates the mold cavity such that the mold cavity has platinum crossing the mold cavity. After curing and removal of the fugitive pattern, a mold is formed of a titanium-containing article (see FIG. 17*a*). Fine scale calcium aluminate particles are used in one example, along with large scale particles that are substantially hollow.

The method may further comprise introducing oxide particles to the slurry before introducing the slurry into a vessel for making a mold. The oxide particles that are used in the presently taught method comprise aluminum oxide particles, magnesium oxide particles, calcium oxide particles, zirconium oxide particles, titanium oxide particles, or combinations thereof. The oxide particles used in the presently taught method may comprise hollow oxide particles. In a particular example, the oxide particles comprise hollow aluminum oxide (alumina) spheres.

FIGS. 9-12 show the transverse slice from the cored section of the casting. The transverse slice was cut along the sides and the slice separated into two halves. This allowed the residual core to be removed and the internal surface of the hollow casting to be examined. The figures of the internal surface of the casting show regions where the core was completely removed and grit blasted; the surface finish was shown to be acceptable.

The images of the internal surface of the casting also show regions where the core was not completely removed; this allows one to gauge the level of interaction between the core and the casting. As was seen, there was only a very thin scale of the calcium aluminate containing core on the casting, and this scale can be easily removed by grit blasting, wire brushing, citrus washing, chemical cleaning, or other means well known in the art. The inventors of the instant disclosure were able to conceive using the results of these investigations that a fine scale calcium aluminate and large scale hollow particle-containing core is a suitable technology for casting hollow titanium alloy and titanium aluminide alloy components.

The details of the disclosure pertaining to the mold making, including incorporation of the core in the mold, and the casting processes are further elaborated upon below. The core is typically set in the wax pattern at a suitable position in the wax so as to provide the subsequent casting with hollow sections in the required regions of the casting to a specific level of accuracy. These techniques can provide a positional accuracy for the hollow cavity within less than 0.4 mm of the position typically required by the specification for the component. Typically, the position of the hollow cavity in a casting is controlled to tolerances of less than 0.4 mm; the tolerance on the hollow cavity position is controlled by the control of the position of the core in the wax; the use of the suitably designed tooling and consumable or non-consumable core supports, such as platinum pins is also another feature of the present disclosure.

One aspect of the present disclosure is a method for forming a casting mold for casting a hollow titanium-containing article, the method comprising: combining calcium aluminate with a liquid to produce a slurry of calcium aluminate, wherein the percentage of solids in the initial calcium aluminate/liquid mixture is about 70% to about 80% and the viscosity of the slurry is about 50 to about 150 centipoise; adding large scale hollow oxide particles into the slurry such that the solids in the final calcium aluminate/liquid mixture with the large-scale (greater than about 70 microns and less than about 1000 microns) oxide particles is about 75% to about 90%; introducing the slurry into a vessel for making a mold that contains a fugitive pattern; and allowing the slurry to cure in the vessel for making a mold to form a mold for casting a hollow titanium-containing article.

An investment mold was formed by formulating the investment mix of the ceramic components, and pouring the mix into a vessel that contains a fugitive pattern. The investment mold was formed on the wax pattern and it was allowed to cure thoroughly to form a so-called green mold. In one embodiment, the curing step is conducted for one hour to about 48 hours, at a temperature of, for example, below about 30 degrees Celsius.

The fugitive pattern was then selectively removed from the green mold by melting, dissolution, ignition, oven dewaxing, furnace dewaxing, steam autoclave dewaxing, or microwave dewaxing, or other known pattern removal technique. Typical methods for wax pattern removal include oven dewax (less than 150° C.), furnace dewax (greater than 150° C.), steam autoclave dewax, and microwave dewaxing. The result was a mold with a core positioned within the mold cavity at the correct position for the subsequent casting.

Although the present disclosure teaches the use of a single core in the casting mold cavity, it is possible to use multiple cores of different geometries to generate different cavities as required at different locations in the casting mold. For example, in one embodiment, the casting mold has two, three or four different cavity locations in which each has a core within it. In one embodiment where more than one core is used, the cores may be connected to each other through a channel connecting two or more cavities housing the cores. In one embodiment where more than one core is used, the cores are separate, each within a defined location and not in contact with any other core. In another embodiment where more than one core is used, the composition of each of the cores may be different. Properties such as core strength, core compliance, and core crushability may be adjusted according to the casting requirements for specific locations of the mold. In another embodiment where more than one core is used, all the cores have the same composition as each other.

The treatment of the core and the mold from room temperature to the final firing temperature is also one feature of the present disclosure, specifically the thermal conditions and the humidity profile. The heating rate to the firing temperature and the cooling rate after firing are other features of the present disclosure. The firing process removes the water from the mold and converts the mayenite in the calcium aluminate particles to calcium aluminate. Another purpose of the mold firing procedure is to minimize any free silica that remains in the core and mold prior to casting. Other purposes are to remove the water, increase the high temperature strength, and increase the amount of calcium monoaluminate and calcium dialuminate.

For casting hollow titanium or titanium alloy-containing components, the green mold is fired at a temperature above 600 degrees Celsius, for example 600 to 1400 degrees Celsius, for a time period in excess of 1 hour, preferably 2 to 10 hours, to develop mold strength for casting and to remove any undesirable residual impurities in the mold, such as metallic species (Fe, Ni, Cr), and carbon-containing species. In one example, the firing temperature is at least 950 degrees Celsius. The atmosphere of firing the mold is typically ambient air, although inert gas or a reducing gas atmosphere can be used.

The mold with the core in it is heated from room temperature to the final firing temperature, specifically the thermal history is controlled. The heating rate to the firing temperature, and the cooling rate after firing are typically regulated. If the mold is heated too quickly, it can crack internally or externally, or both; mold cracking prior to casting is highly undesirable. In addition, if the mold is heated too quickly, the internal surface of the mold can crack and spall off. This can lead to undesirable inclusions in the final casting, and poor surface finish, even if there are no inclusions. In addition, if the mold and core assembly is heated too quickly, the core can crack and the subsequent cast component will not possess the designed hollow cavity within it. Similarly, if the mold is cooled too quickly after reaching the maximum temperature, the mold can also crack internally or externally, or both.

The present disclosure also teaches a method for making a casting mold for casting a hollow titanium-containing article. The casting mold comprises an investment casting mold for casting near-net-shape titanium aluminide articles. In certain embodiments, the casting-mold composition of the present disclosure comprises an investment casting-mold composition comprising a core. The investment casting-mold composition comprising the core comprises a near-net-shape, titanium-containing metal, investment casting mold composition. In one embodiment, the investment casting-mold composition comprises an investment casting-mold composition for casting near-net-shape titanium aluminide articles. The near-net-shape titanium aluminide articles comprise, for example, near-net-shape titanium aluminide turbine blades. This near-net-shape, titanium aluminide turbine blade may require little or no material removal prior to installation.

Net shape casting approaches as provided for in the present disclosure allow parts that can be inspected with non destructive methods, such as x-ray, ultrasound, or eddy current, in greater detail and at lower costs. The difficulties associated with attenuation and scattering of the inspection radiation in oversized thick sections is reduced. Smaller defects can potentially be resolved, and this can provide parts with improved mechanical performance.

Moreover, the present disclosure also teaches a casting method for hollow titanium and titanium alloys. The method comprises obtaining an investment casting mold composition comprising calcium aluminate particles and large scale particles, pouring this composition into a vessel containing a fugitive pattern, curing it, removing the fugitive pattern from the mold, and preheating the mold to a mold casting temperature. Subsequently, molten titanium or titanium alloy is poured into the heated mold and allowed to solidify to form a solidified hollow titanium or titanium alloy casting (see FIG. 17*b*).

The solidified hollow titanium or titanium alloy casting is then removed from the mold. In one embodiment, after removing of the titanium or titanium alloy from the mold, the casting may be finished with grit blasting or polishing. In one embodiment, after the solidified casting is removed from the mold, it is inspected by X-ray radiography. The disclosure also teaches titanium or titanium alloy articles, e.g. a turbine blade, made by the casting method as taught herein.

The solidified casting is subjected to surface inspection and X-ray radiography after casting and finishing to detect any sub-surface inclusion particles at any location within the casting. X-ray radiography is employed to find inclusions that are not detectable by visual inspection of the exterior surface of the casting. The titanium aluminide casting is subjected to X-ray radiography (film or digital) using conventional X-ray equipment to provide an X-ray radiograph that then is inspected or analyzed to determine if any sub-surface inclusions are present within the titanium aluminide casting.

Another aspect of the present disclosure is a method for forming a casting mold for casting a hollow titanium-containing article. The formed mold may be a green mold, and the method may further comprise firing the green mold. In one embodiment, the casting mold comprises an investment casting mold, for example, for casting a hollow titanium-containing article. In one embodiment, the investment casting-mold composition comprises an investment casting-mold composition for casting near-net-shape titanium aluminide articles. The near-net-shape titanium aluminide articles may comprise near-net-shape titanium aluminide turbine blades. In one embodiment, the disclosure is directed to a mold formed from a hollow titanium-containing article casting-mold composition, as taught herein. Another aspect of the present disclosure is directed to a hollow article formed in the aforementioned mold.

The new core composition described in the present disclosure is particularly suitable for titanium and titanium aluminide alloys. The present disclosure is directed, inter alia, to a ceramic core composition comprising calcium aluminate particles and one or more large scale particles. The composition comprises fine scale calcium aluminate and said large particles. The large scale particles can be hollow. The calcium aluminate particles may comprise particles of calcium monoaluminate, calcium dialuminate, and mayenite. The calcium aluminate particles may comprise particles of calcium monoaluminate and calcium dialuminate. The present disclosure also teaches a casting core formed from a ceramic core composition comprising calcium aluminate particles and one or more large scale particles. The instant disclosure is also directed to hollow titanium aluminide-containing articles formed using a casting core formed from a ceramic core composition comprising calcium aluminate particles and one or more large scale particles. An example of a hollow titanium aluminide-containing article is a hollow titanium aluminide turbine blade.

The core and the mold composition after firing and before casting are features of the present disclosure, particularly with regard to the constituent phases. For casting purposes, a relatively high weight fraction of calcium monoaluminate in the core and the mold is preferred (at least 25 weight percent of the total mold weight). In addition, for casting purposes, it is desirable to minimize the volume fraction of the mayenite in the mold because mayenite is water sensitive and it can provide problems with water release and gas generation during casting. Further details are provided in Table 1.

TABLE 1

Weight percent ranges of the calcium monoaluminate, calcium dialuminate, and mayenite in the fine-scale calcium aluminate cement that is used in the mold and core.

| | Range of calcium monoaluminate | Range of calcium dialuminate | Range of mayenite |
|---|---|---|---|
| Fine-scale Calcium aluminate in Mold | 5%-95% | 5%-80% | 1%-30% |
| Fine-scale Calcium aluminate in Core | 10%-90% | 5%-80% | 0.1%-5% |

In addition, it is desirable to minimize the volume fraction of the mayenite in the core; lower levels of mayenite have to be maintained in the core than in the mold, as described in the attached table. After firing, the mold and the core can also contain small weight fractions of aluminosilicates and calcium aluminosilicates; it is desirable that the sum of the weight fraction of aluminosilicates and calcium aluminosilicates is kept to less than about 5% in the mold and in the core, in order to minimize reaction of the mold with the casting. In one example, the sum of the weight fraction of aluminosilicates and calcium aluminosilicates is less than about 3% in the mold and in the core. In another example, the sum of the weight fraction of aluminosilicates and calcium aluminosilicates is less than about 1% in the mold and in the core.

TABLE 2

Mold and core ranges of weight percent of the fine-scale calcium aluminate cement and range of weight percent of the large-scale particles. Also included are the preferred limit for the weight percent of silica, and the preferred limit for the combination of aluminosilicates and calcium aluminosilicates.

| | Range of weight percent of the fine-scale calcium aluminate cement | Range of weight percent of the large-scale particles | Range of weight percent of silica | Range of weight percent of sum of aluminosilicates and calcium aluminosilicates |
|---|---|---|---|---|
| Mold | More than 30% | 20% to 70% | <2% | <5% |
| Core | 20% to 80% | 20% to 65% | <0.5% | <5% |

The selection of the correct calcium aluminate particle chemistry and alumina formulation are features of the present disclosure. They are determinants of the performance of the mold during casting.

The calcium aluminate particles used in aspects of the disclosure typically comprises three phases or components of calcium and aluminum: calcium monoaluminate ($CaAl_2O_4$), calcium dialuminate ($CaAl_4O_7$), and mayenite ($Ca_{12}Al_{14}O_{33}$). Calcium monoaluminate's hydration contributes to the high early strength of the investment mold. Mayenite is desirable because it provides strength during the early stages of mold curing due to the fast formation of hydraulic bonds. The mayenite is, however, typically removed during heat treatment of the mold prior to casting.

The mayenite is incorporated in the mold in both the mold and core because it is a fast setting calcium aluminate and it is believed to provide the mold with strength during the early stages of curing. Curing may be performed at low temperatures, for example, temperatures between 15 degrees Celsius and 40 degrees Celsius because the fugitive wax pattern is temperature sensitive and loses its shape and properties on thermal exposure above about 35 degrees Celsius. It is preferred to cure the mold at temperatures below 30 degrees Celsius.

The selection of the correct calcium aluminate particle chemistry and alumina formulation are factors in the performance of the core during casting. In one embodiment, the casting mold composition further comprises calcium oxide. In another embodiment, the casting core composition further comprises calcium oxide. In terms of the calcium aluminate particles, it may be necessary to minimize the amount of free calcium oxide in order to minimize reaction with the titanium alloy. If the calcium oxide concentration is less than about 10% by weight, the alloy reacts with the mold and core because the alumina concentration is too high, and the reaction generates undesirable oxygen concentration levels in the casting, gas bubbles, and a poor surface finish in the cast component. Free silica is less desirable in the mold and the core material because it can react aggressively with titanium and titanium aluminide alloys. It is also desirable to minimize the amount of free alumina that is in contact with the molten alloy after the molten alloy is poured into the mold.

The final mold typically may have a density of less than 2 grams/cubic centimeter and strength of greater than 500 pounds per square inch [psi]. The final core typically may have a density of less than 3.5 grams/cubic centimeter and strength of greater than 150 pounds per square inch [psi].

The casting mold composition and the core composition may differ. For example, the calcium monoaluminate in the mold comprises a weight fraction of about 0.05 to 0.95, and the calcium monoaluminate in the core is about 0.1 to 0.90. In another embodiment, the calcium dialuminate in the mold comprises a weight fraction of about 0.05 to about 0.80, and the calcium dialuminate in the core is about 0.05 to 0.90. In yet another embodiment, the mayenite in the mold composition comprises a weight fraction of about 0.01 to about 0.30, and the mayenite in the core is about 0.001 to 0.05, as shown in Table 1.

In one embodiment, the weight fractions of these phases that are suitable in the mold are 0.05 to 0.95 of calcium monoaluminate, 0.05 to 0.80 of calcium dialuminate, and 0.01 to 0.30 of mayenite. Whereas, in one example, the weight fractions of these phases in the core composition are 0.1 to 0.90 of calcium monoaluminate, 0.05 to 0.90 of calcium dialuminate, and 0.001 to 0.05 of mayenite. In another embodiment, the weight fraction of calcium monoaluminate in the core is more than about 0.6, and the weight fraction of mayenite is less than about 0.1. In one embodiment, the weight fraction of calcium monoaluminate in the mold is more than about 0.5, and weight fraction of mayenite is less than about 0.15.

Prior to casting a molten metal or alloy, the investment mold and core may be preheated to a mold casting temperature that is dependent on the particular component geometry or alloy to be cast. For example, a mold and core preheat temperature is 600 degrees Celsius. In one embodiment, the mold and core temperature ranges from about 450 degrees Celsius to about 1200 degrees Celsius. In another example, this range is from about 450 degrees Celsius to about 750 degrees Celsius. In a particular embodiment, the mold temperature ranges from about 500 degrees Celsius to about 650 degrees Celsius.

The molten metal or alloy is poured into the mold that contains the core using conventional techniques which can include gravity, countergravity, pressure, centrifugal, and other casting techniques known to those skilled in the art. Vacuum or inert gas atmospheres can be used. For complex shaped thin wall geometries, techniques that use high pressure are preferred. After the solidified titanium aluminide or alloy casting is cooled to less than 650 degrees Celsius (typically to room temperature), it is removed from the mold and finished using conventional techniques, such as grit blasting, water jet blasting, and polishing. The core can also be removed by preferential leaching techniques.

In particular, the present disclosure also teaches, in one example, a method for casting a hollow turbine component. As shown in FIG. 18*b*, the method comprises making a ceramic core, 1822, by combining calcium aluminate particles with large scale particles and a liquid to form a slurry, introducing the slurry into a die to produce a green product of an article-shaped body, and heating the green product under conditions sufficient to form a sintered ceramic core. Having made the ceramic core 1822, the ceramic core is then disposed in a pre-selected position within a mold, 1824. Molten titanium or titanium alloy-containing material is then introduced into the mold, 1826, and cooled to form the turbine component within the mold, 1828. The mold is then separated from the turbine component, 1830, and the core is removed from the turbine component, 1832, so as to form a hollow turbine component. The turbine component being cast can be a turbine blade.

The core composition, in one example, does not shrink more than about one percent upon firing at about 700 to about 1400 degrees Celsius for about one hour. The core composition, in another example, does not shrink more than about five percent upon firing at about 700 to about 1400 degrees Celsius for about one hour. The core composition may be sintered and after the ceramic core composition is sintered, the ceramic core that is formed is substantially free of silica. The ceramic core may comprise hollow alumina particles before sintering, and after sintering the core comprises, in one example, no more than about 0.5% by weight (based on the total weight of the core) of free silica.

For the casting method, fine scale calcium aluminate particles may be used, along with large scale particles that are substantially hollow. After removing the fugitive pattern from the mold and preheating the mold to a mold casting temperature, in one example, the mold is heated to a temperature of about 450 degrees Celsius to about 1400 degrees Celsius and then allowed to cool to about room temperature. The fugitive pattern may be removed by at least one of melting, dissolution, ignition, oven dewaxing, furnace dewaxing, steam autoclave dewaxing, or microwave dewaxing. After removing the solidified titanium or titanium alloy casting from the mold, the casting may be inspected with X-ray radiography.

In particular, the solidified casting is also subjected to surface inspection and x-ray radiography after casting and finishing in order to detect any sub-surface ceramic inclusion particles at any location within the casting. The titanium aluminide alloy casting can be subjected to x-ray radiography (film or digital) using conventional x-ray equipment to provide an x-ray radiograph that then is inspected or analyzed to determine if any sub-surface inclusions are present within the titanium aluminide alloy casting.

The calcium aluminate particles provide the core with the ability to withstand reaction of the ceramic core with the molten titanium alloy. The hollow alumina particles provide the core with compliance and crushability; these are features of the present disclosure because it is necessary that the core does not impose excessive tensile stress on the casting during post solidification cooling. The core may have a lower thermal expansion coefficient than the metal, and the metal cools more quickly than the ceramic.

The strength of the core is determined in that if the core is too strong, the core will impose tensile stress on the part because the part shrinks more quickly than the core during post solidification cooling. The inventors of the instant application conceived of a core that crushes during cooling, such that it does not impose excessive tensile stress on the part and generate tensile tears, cracks, and defects.

The crushability of the core is designed such that the tensile stresses do not generate a crack that is larger than 1 mm in the casting. The crushability is affected by, for example, adjusting the weight fraction of the large scale particles, for example large scale hollow alumina particles, and the density of the core. Cores that have lower density have higher crushability and they impose lower stresses on the casting. The lower density can be affected by a higher weight fraction of large scale hollow alumina particles or more porosity in the core.

The crushability of the core is designed such that the tensile stresses do not generate a crack that is larger than 1 mm in the casting. The crushability of the core is designed, in one example, such that the tensile stresses do not generate a crack that is larger than 0.5 mm in the casting. In one example, the crushability of the core is designed such that the tensile stresses do not generate a crack that is larger than 0.1 mm in the casting.

The diameter, length, and positions of the platinum pins are selected so as to minimize the movement of the casting core during mold processing and casting. It is preferred that the casting core does not move more than 125 microns from the preferred position of the core in the final casting prior to removal of the core from the casting. It is preferred that the casting core does not move more than 75 microns from the preferred position of the core in the final casting prior to removal of the core from the casting. In one example, the casting core does not move more than 25 microns from the preferred position of the core in the final casting prior to removal of the core from the casting.

The present disclosure provides a core and a mold that can provide a net shape hollow casting that can be inspected with non destructive methods, such as x-ray, ultrasound, or eddy current, in greater detail and at lower costs. The difficulties associated with attenuation and scattering of the inspection radiation in oversized thick sections is reduced due to the net shape casting. Smaller defects can potentially be resolved, and this can provide parts with improved mechanical performance.

The mold composition for casting a hollow titanium-containing article may comprise calcium aluminate particles and a ceramic core as described herein. The ceramic core composition described in the present disclosure is particularly suitable for hollow titanium and titanium aluminide alloys. The mold and core composition after firing and before casting can influence the mold properties, particularly with regard to the constituent phases. In one embodiment, for casting purposes, a high weight fraction of calcium monoaluminate in the mold is preferred, for example, a weight fraction of 0.15 to 0.8. In addition, for casting purposes, it is desirable to minimize the weight fraction of the mayenite, for example, using a weight fraction of 0.01 to 0.2, because mayenite is water sensitive and it can provide problems with water release and gas generation during casting.

After firing, the mold and the core can also contain small weight fractions of aluminosilicates and calcium aluminosilicates. The sum of the weight fraction of aluminosilicates and calcium aluminosilicates may typically be kept to less than 5% in the mold, in order to minimize reaction of the mold with the casting. The sum of the weight fraction of aluminosilicates and calcium aluminosilicates may typically be kept to less than 5% in the core, in order to minimize reaction of the core with the casting.

The present disclosure provides a casting mold composition and a casting process that can provide improved components of titanium and titanium alloys, in particular hollow titanium turbine blades. External properties of the casting include features such as shape, geometry, and surface finish. Internal properties of the casting include mechanical properties, microstructure, and defects (such as pores and inclusions) below a particular size.

Examples

The disclosure, having been generally described, may be more readily understood by reference to the following examples, which are included merely for purposes of illustration of certain aspects and embodiments of the present disclosure, and are not intended to limit the disclosure in any way.

Aspects of the present disclosure provide ceramic core compositions, methods of casting, and cast articles that overcome the limitations of the conventional techniques. Though some aspect of the disclosure may be directed toward the fabrication of components for the aerospace industry, for example, engine turbine blades, aspects of the present disclosure may be employed in the fabrication of any component in any industry, in particular, those components containing titanium and/or titanium alloys.

Fine scale calcium aluminate particles were mixed with large scale alumina, in one example large scale hollow alumina particles, to generate an investment mold mix, and a range of investment mold chemistries were tested. The investment mixture in one example consisted of calcium aluminate particles with 80% alumina and 20% calcia, alumina particles, water, and colloidal silica.

Furthermore, the present disclosure also teaches a method for making a casting mold for casting a hollow titanium-containing article. As shown in FIG. 17*a*, the method comprises combining calcium aluminate particles, large scale particles and a liquid to produce a slurry, 1705. This slurry containing calcium aluminate particles and large scale particles in the liquid is then introduced into a vessel for making a mold that contains a fugitive pattern, 1707, and allowed to cure in the vessel for making a mold to form a mold of a titanium-containing article, 1709. Fine scale calcium aluminate particles are used in one example, along with large scale particles that are substantially hollow. In a particular example, the percentage of solids in the initial fine scale calcium aluminate and liquid mixture was about 60% to about 80% and the viscosity of the slurry is about 30 to about 150 centipoise. The oxide particles are, in one example, added into the slurry 1705 such that the solids in the final calcium aluminate and the large scale oxide particle (greater than 70 microns) liquid mixture is about 75% to about 90%. The calcium aluminate slurry is introduced into a vessel for making a mold that contains a fugitive pattern 1707, and allowed to cure in the vessel for making a mold to form a mold of a titanium or titanium-containing article 1709.

In another example, the present disclosure teaches a casting method for hollow titanium and titanium alloys. As shown in FIG. 17*b*, the method comprises obtaining an investment casting mold composition comprising calcium aluminate particles and large scale particles, 1722. The casting method also comprises a ceramic core. In one example, the calcium aluminate is combined with a liquid to produce a slurry of calcium aluminate, wherein the solids in the final calcium aluminate/liquid mixture with a large scale alumina is about 75% to about 90%.

This investment casting mold composition is then poured, 1724, into a vessel containing a fugitive pattern and cured, 1726. The vessel controls the external dimensions of the resulting mold. The fugitive pattern is then removed from the mold, 1728, and the mold is preheated to a mold casting temperature, 1730. Subsequently, molten titanium or titanium alloy is poured into the heated mold, 1732, and allowed to solidify to form a solidified hollow titanium or titanium alloy casting, 1734. The solidified hollow titanium or titanium alloy casting is then removed from the mold, 1736. The disclosure also teaches titanium or titanium alloy articles made by the casting method as taught herein. The article may be a titanium aluminide-containing turbine blade.

Applicants also herein disclose a method of making a ceramic core. As shown in FIG. 18*a*, the method includes combining calcium aluminate particles with large scale particles and a liquid to form a slurry, 1805. This slurry is then introduced into a die to produce a green product of an article-shaped body 1807, and the green product is then heated under conditions sufficient to form a ceramic core, 1809. For making the ceramic core, fine scale calcium aluminate particles may be used along with large scale particles that are substantially hollow.

The present disclosure also teaches a method for casting a hollow turbine component. As shown in FIG. 18*b*, the method comprises making a ceramic core, 1822, by combining calcium aluminate particles with large scale particles and a liquid to form a slurry, introducing the slurry into a die of an article-shaped body, and heating the green product under conditions sufficient to form a sintered ceramic core. Having made the ceramic core 1822, the ceramic core is then disposed in a pre-selected position within a mold, 1824. Molten titanium or titanium alloy-containing material is then introduced into the mold, 1826, and cooled to form the turbine component within the mold, 1828. The mold is then separated from the turbine component, 1830, and the core is removed from the turbine component, 1832, so as to form a hollow turbine component. The turbine component being cast can be a turbine blade.

In one example, before introducing the slurry into the die to produce the green product of an article-shaped body, the calcium aluminate is combined with a liquid and large scale particles to produce a slurry of calcium aluminate and hollow large scale, wherein the solids in the mixture is about 75% to about 90%. Additional methods for making the core include injection molding. For example, the method comprises making a ceramic core, 1822, by combining calcium aluminate particles with large scale particles and an wax to form an injection molding formulation, introducing the formulation into a die that represents the shape of an article-shaped body of the core that is required. The formulation is injected into the die at temperatures in the range of 60 to 120 degrees Celsius and then cooled before removal from the die. The core is then heated under conditions sufficient to remove the wax and form a sintered ceramic core. Having made the ceramic core, the ceramic core is then disposed in a pre-selected position within a mold for casting.

Figure 4:
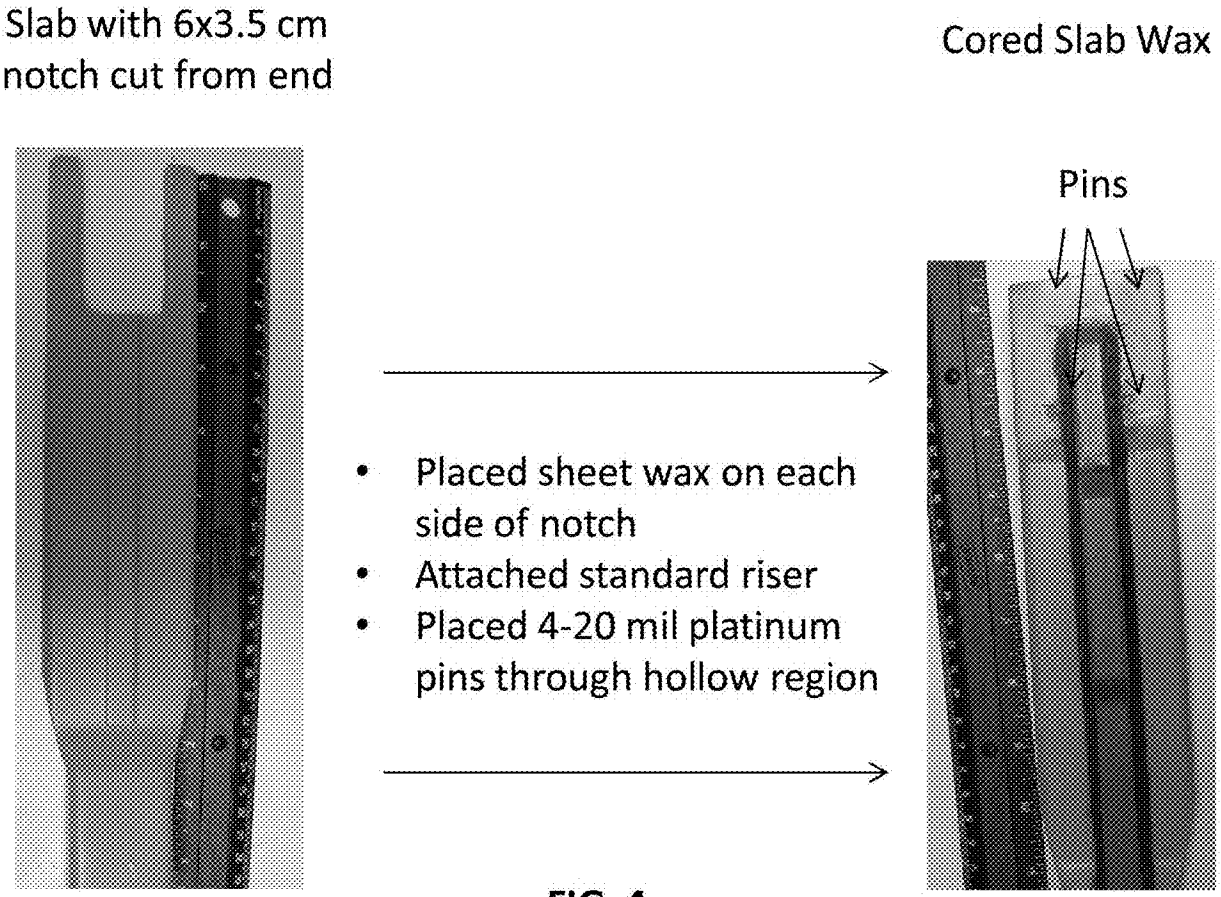
FIG. 4 shows the preparation of a wax for making a slab with a core positioned inside the resulting slab for development of the present core technology. In order to make the cored slab, a conventional slab wax was generated and a section of the wax at the end of the slab was removed. The end surfaces of the slab were then reconstructed using sheet wax that was joined to the end of the slab leaving the end surface of the slab wax exposed. Platinum pins were then inserted perpendicular to the sides of the slab through the sheet wax and across the cavity. The platinum pins were arranged so that they penetrated both sides of the slab wax and they were supported in the cavity by the sheet wax on each side. The red wax on the top of the slab wax is a riser that is employed to accommodate solidification shrinkage in the slab casting.

In another example a hollow slab casting was produced in order to test a core formulation that consisted of 65 weight percent of a calcium aluminate cement and 35 weight percent of a hollow alumina bubble. FIG. 4 shows the preparation of a wax for making a slab with a core positioned inside the resulting slab for development of the present core technology. Platinum pins were inserted perpendicular to the sides of the slab through the sheet wax and across the cavity. The platinum pins were arranged so that they penetrated both sides of the slab wax and they were supported in the cavity by the sheet wax on each side. The core was set in the end of the slab wax as shown. The platinum pins were used to stabilize the position of the core in the wax and subsequent mold.

In order to produce the mold around the slab wax, a slurry mixture for making an investment mold consisted of 5416 g of a commercially blended 80% calcium aluminate cement. The calcium aluminate cement nominally consists of a 70% calcium aluminate cement blended with alumina to adjust the composition to 80% alumina. A cement slurry was produced using 1641 g of deionized water, and 181 g of colloidal silica. When the slurry was mixed to an acceptable viscosity, 2943 g of substantially hollow alumina (bubble) of a size range of less than 0.85 mm and greater than 0.5 mm in outside dimension was added to the slurry. The solids loading of the mix was greater than 70%. After mixing, the investment mold mix was poured in a controlled manner into a molding vessel. The solids loading of the final mold mix was approximately 83%. The mold mix poured well with satisfactory viscosity and rheology.

After curing, the molded part was of good strength and uniform composition. The mold was fired at a temperature of 1000° C. for 4 hours. This formulation produced a mold that was approximately 120 mm diameter and 400 mm long. The mold formulation was designed so that there was less than 1 percent linear shrinkage of the mold, and the mold, on firing. The mold that was produced had a density of less than about 2 grams per cubic centimeter.

After firing, the mold was used to cast a slab with a hollow section at the end of the slab produced by the calcium aluminate containing core. FIG. 1 shows a typical slab casting that was used to develop the core composition of the present disclosure. The slab is a simple geometry with a pour cup and a riser to allow for solidification shrinkage. FIG. 8 shows a titanium alloy (titanium aluminide) slab casting that was produced using the mold with the core within the mold. It shows the sliced core slab, showing transverse sections that allow the calcium aluminate containing core to be observed directly. The core was partially removed by grit blasting, and the internal surface of the casting can be observed. A region of the casting with the core partially removed can be seen. The internal surface of the casting that was generated by the core can be seen to be of high quality. The surface finish of the hollow section produced by the core was approximately 100 Ra.

The mold mix was prepared by mixing the calcium aluminate particles, water, and colloidal silica in a container. A high-shear form mixing was used. If not mixed thoroughly, the particles can gel, and the fluidity is reduced so that the mold mix will not cover the fugitive pattern uniformly. When the fine scale calcium aluminate particles are in full suspension, the hollow large scale alumina particles are added. In some instances, progressively larger sized hollow alumina particles were added, from about 70 microns to about 100 microns over a period of about two hours. When the large-scale alumina particles were fully mixed with the fine scale calcium aluminate particles, the larger-sized (for example, 300 to 1000 microns) alumina particles were added and mixed with the fine scale calcium aluminate-hollow alumina formulation.

The viscosity of the final mix is another factor for the core composition, as it must not be too low or too high. Another factor of the present disclosure is the solids loading of the particle mix and the amount of water. After mixing, the investment mix was poured in a controlled manner into a vessel that contains the fugitive wax pattern. The dimensions of the vessel control the external dimensions of resulting mold. The vessel provides the external geometry of the mold, and the fugitive pattern generates the internal geometry. The correct pour speed is a further feature, if it is too fast air can be entrapped in the mold, if it is too slow separation of the cement and the alumina particulate can occur. Suitable pour speed range from about 1 to about 20 liters per minute. In one embodiment, the pour speed is about 2 to about 6 liters per minute. In a specific embodiment, the pour speed is about 4 liters per minute.

The solids loading of the final mold mix was more than 80 percent, where the solids loading is defined as the total solids in the mix normalized with respect to the total mass of the liquid and solids in the mix, expressed as a percentage.

The mold formulation was designed so that there was less than 1 percent linear shrinkage of both the facecoat of the mold, and the mold, on firing. The lightweight fused alumina hollow particles incorporated in the mix provides low thermal conductivity.

The alumina hollow particles provide a core composition with a reduced density compared to fully dense alumina and lower thermal conductivity compared to fully dense alumina. In this example, the core has 35% weight percent of hollow alumina particles.

This formulation produced a core composition and a mold that was approximately 120 mm diameter and 400 mm long. The mold was then cured and fired at high temperature. The composition was used for casting titanium aluminide-containing articles, such as turbine blades, with a good surface finish. The roughness (Ra) value was less than 100, and with an oxygen content of less than 2000 ppm. This formulation produced a mold that had a density of less than 1.8 grams per cubic centimeter. The thermal conductivity of the core is substantially less than that of alumina at all temperatures. The thermal conductivity was measured using hot wire platinum resistance thermometer technique (ASTM test C-1113).

In another example, a low pressure turbine blade was produced with a calcium aluminate core inside it. The core was made of a formulation that consisted of 540 g of calcium aluminate cement, 292 g of large scale alumina particles, 164 g of deionized water, and 181 g of colloidal silica. A cement slurry was produced using the calcium aluminate cement, the deionized water, and the colloidal silica. When the slurry was mixed to an acceptable viscosity, 294 g of alumina particles of a size range of less than 0.85 mm and greater than 0.5 mm in outside dimension was added to the slurry. The slurry was then poured into a cavity that was the inverse of the shape of the hollow cavity that was required in the final cast component.

The core was cured in the cavity for 24 hours at a temperature of 21 degrees Celsius and at a humidity level of 20%. The core was cured and it was set in position in a turbine airfoil wax with platinum pins. The platinum pin diameter was 0.5 mm and there was a maximum spacing of 35 mm between the platinum pins. The pins and their configuration with respect to the core were used to control the position of the ceramic core during mold curing, mold dewax, mold firing, and casting. The core formulation that was used consisted of 65 weight percent of a calcium aluminate cement and 35 weight percent of alumina particles. The core formulation experienced less than 1% linear shrinkage on firing.

In this example, a hollow casting was produced in order to test a core formulation that consisted of 65 weight percent of a calcium aluminate cement and 35 weight percent of a hollow alumina bubble.

In order to produce the mold around the airfoil wax, a slurry mixture for making an investment mold that consisted of 5416 g of a commercially blended 80% calcium aluminate cement and 2943 g of alumina was used. A cement slurry was produced using 5416 g of cement, 1641 g of deionized water, and 181 g of colloidal silica. When the slurry was mixed to an acceptable viscosity, 2943 g of hollow alumina (bubble) of a size range of less than 0.85 mm and greater than 0.5 mm in outside dimension was added to the slurry.

The turbine airfoil blade wax with the core set in it was then positioned in a vessel to generate the mold around the blade wax. After mixing, the investment mold mix was poured in a controlled manner into a vessel to produce the mold. The solids loading of the final mold mix was approximately 83%. The mold was fired at a temperature of 1000° C. for 4 hours. The mold and core were fired together. This formulation produced a mold that was approximately 120 mm diameter and 400 mm long. The mold formulation was designed so that there was less than 1 percent linear shrinkage of the mold, and the bulk of the mold, on firing. After firing, the mold was used to cast a turbine airfoil with a hollow section that was generated by the use of the calcium aluminate-containing core.

The weight percent of silica in the mold was less than 2 percent and weight percent of silica in the core was less than 0.5% weight percent. High concentrations of silica in the mix can lead to residual crystalline silica, and silicates, such as calcium aluminosilicate and aluminosilicate in the final fired mold and core. High silica contents of the mold and the core can provide two limitations for casting molds and cores. First, shrinkage can occur on firing and this leads to problems, such as cracking. Second, the high silica content can cause reaction with the molten titanium and titanium aluminide alloys when the mold, and mold plus core assembly, is filled during casting; this reaction leads to unacceptable casting quality. The silica level of the core is lower than the silica level in the mold to prevent reaction and provide improved control of the dimensions of the internal cavity within the cast airfoil.

In a particular example, Duralum AB alumina hollow particles may be used. In certain aspects, the disclosure teaches core compositions formed with a low silica content. The low silica content of the core provides a mold that is preferred for casting titanium and titanium aluminide alloys. In one example, the weight percentage of alumina hollow particles in the mold was about 35 percent, and the mold experienced less than 1 percent linear shrinkage on firing.

If the working time of the investment mold mix is too long and the calcium aluminate particles do not cure sufficiently quickly, separation of the fine-scale particles and the large scale alumina can occur and this can lead to a segregated mold in which the formulation varies and the resulting mold properties are not uniform.

The constituent phases in the calcium aluminate particles that provides the binder for the mold and the core are features of the present disclosure. The three phases of the calcium aluminate particles comprise calcium monoaluminate ($CaAl_2O_4$), calcium dialuminate ($CaAl_4O_7$), and mayenite ($Ca_{12}Al_{14}O_{33}$). The inventors made this selection to achieve several purposes. First, the phases must dissolve or partially dissolve and form a suspension that can support all the aggregate phases in the subsequent investment mold making slurry. Second, the phases must promote setting or curing of the mold after pouring. Third, the phases must provide strength to the mold during and after casting. Fourth, the phases must exhibit minimum reaction with the titanium alloys that is cast in the mold. Fifth, the mold must have a suitable thermal expansion match with the titanium alloy casting in order to minimize the thermal stress on the part that is generated during post-solidification cooling.

The mayenite is incorporated in the mold and core because it is a fast setting calcium aluminate and it provides the mold with strength during the early stages of curing. Curing must be performed at low temperatures, because the fugitive wax pattern is temperature sensitive and loses its shape and properties on thermal exposure above ~35 degrees Celsius. In one example, the mold is cured at temperatures below 30 degrees Celsius. In one embodiment, there is no mayenite present in the core.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description.

The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method for making a casting mold for casting a hollow titanium-containing article, said method comprising:

a) combining calcium aluminate particles, large scale particles and a liquid to produce a slurry of calcium aluminate particles and large scale particles in the liquid wherein the calcium aluminate particles comprise particles of up to about 50 microns in outside dimension;

b) introducing the slurry into a mold cavity that contains a fugitive pattern; and c) allowing the slurry to cure in the mold cavity to form a mold of a titanium-containing article.

2. The method as recited in claim 1, wherein fine scale calcium aluminate particles are used, along with large scale particles that are substantially hollow.

3. The method as recited in claim 1, wherein the method further comprises introducing oxide particles to the slurry before introducing the slurry into a mold cavity.

4. The method as recited in claim 3, wherein said oxide particles comprise aluminum oxide particles, magnesium oxide particles, calcium oxide particles, zirconium oxide particles, titanium oxide particles, or combinations thereof.

5. The method as recited in claim 3, wherein said oxide particles comprise hollow oxide particles.

6. The method as recited in claim 3, wherein said oxide particles comprise hollow alumina spheres.

7. The method as recited in claim 1, wherein the mold cavity has platinum pins crossing the cavity.

8. The method as recited in claim 1, wherein at least 50% of the calcium aluminate particles are less than about 10 microns in outside dimension.

9. The method as recited in claim 1, wherein the large scale particles comprise particles of from about 70 to about 300 microns in outside dimension.

10. The method as recited in claim 1, wherein said casting mold comprises an investment casting mold for casting near-net-shape titanium aluminide articles.

11. A casting method for hollow titanium and titanium alloys comprising:

a) obtaining an investment casting mold composition comprising calcium aluminate particles and large scale particles wherein the calcium aluminate particles comprise particles of up to about 50 microns in outside dimension;

b) pouring said investment casting mold composition into a vessel containing a fugitive pattern;

c) curing said investment casting mold composition;

d) removing said fugitive pattern from the mold;

e) preheating the mold to a mold casting temperature;

f) pouring molten titanium or titanium alloy into the heated mold;

g) solidifying the molten titanium or titanium alloy and forming a solidified hollow titanium or titanium alloy casting; and h) removing the solidified hollow titanium or titanium alloy casting from the mold.

12. The casting method as recited in claim 11, wherein fine scale calcium aluminate particles are used, along with large scale particles that are substantially hollow.

13. The casting method as recited in claim 11, wherein, between removing said fugitive pattern from the mold and preheating the mold to a mold casting temperature, heating said mold to a temperature of about 450 degrees Celsius to about 900 degrees Celsius, and then allowing said mold to cool to about room temperature.

14. The casting method as recited in claim 11, wherein the removing of the fugitive pattern comprises at least one of melting, dissolution, ignition, oven dewaxing, furnace dewaxing, steam autoclave dewaxing, or microwave dewaxing.

15. The casting method as recited in claim 11, wherein after removing the solidified titanium or titanium alloy casting from the mold, the casting is inspected with one or both of X-ray radiography and Neutron radiography.

* * * * *